US009835400B2

(12) United States Patent
Barrett et al.

(10) Patent No.: US 9,835,400 B2
(45) Date of Patent: Dec. 5, 2017

(54) INTEGRALLY SUPPRESSED BARREL FOR FIREARM

(71) Applicant: Sturm, Ruger & Company, Inc., Southport, CT (US)

(72) Inventors: Jonathan Barrett, Georges Mills, NH (US); Thomas A. Bouffard, Hopkinton, NH (US)

(73) Assignee: STURM, RUGER & COMPANY, INC.

( * ) Notice: Subject to any disclaimer, the term of this patent is extended or adjusted under 35 U.S.C. 154(b) by 0 days.

(21) Appl. No.: 15/251,625

(22) Filed: Aug. 30, 2016

(65) Prior Publication Data

US 2017/0191780 A1 Jul. 6, 2017

Related U.S. Application Data

(63) Continuation-in-part of application No. 14/950,132, filed on Nov. 24, 2015.
(Continued)

(51) Int. Cl.
*F41A 21/30* (2006.01)
*F41A 21/32* (2006.01)

(52) U.S. Cl.
CPC ..... *F41A 21/30* (2013.01); *F41A 21/325* (2013.01)

(58) Field of Classification Search
CPC ..... F41A 21/30; F41A 21/32; F41A 21/325
(Continued)

(56) References Cited

U.S. PATENT DOCUMENTS

D958,934 5/1910 Maxim
981,584 A 1/1911 Miller
(Continued)

FOREIGN PATENT DOCUMENTS

AT 63622 2/1914
CN 202614087 12/2012
(Continued)

OTHER PUBLICATIONS

RANB, "Offset silencer design", Silencer Talk and Modern Rifle, Sound Suppressor Discussion, Apr. 10, 2011.
(Continued)

*Primary Examiner* — Samir Abdosh
(74) *Attorney, Agent, or Firm* — The Belles Group, P.C.

(57) ABSTRACT

An integrally suppressed barrel in one embodiment includes a rear barrel portion defining an axial projectile bore and forwardly extending sleeve affixed to thereto. The sleeve includes vertically stacked tubular upper and lower longitudinal chambers holding a complementary configured horizontal stack of sound suppression baffles. The chambers are in fluid communication via a waist, which may be smaller in width than the chambers. A rod extending from a front end cap on the sleeve to and threadably the rear barrel secures the baffles inside the sleeve. The stack of baffles is removable from the sleeve as a self-supporting unit in one embodiment. The baffles may include upper and lower chambers which are in fluid communication to provide additional volume for gas expansion and sound suppression. The upper chambers include an asymmetrically shaped flow cone configured to direct gas from the upper to lower chambers.

25 Claims, 24 Drawing Sheets

Related U.S. Application Data

(60) Provisional application No. 62/096,977, filed on Dec. 26, 2014.

(58) Field of Classification Search
USPC ..... 89/14.05, 14.4
See application file for complete search history.

(56) References Cited

U.S. PATENT DOCUMENTS

| | | | | |
|---|---|---|---|---|
| 1,111,202 | A | 9/1914 | Westfall | |
| 1,173,687 | A | 2/1916 | Thompson | |
| 1,259,251 | A | 3/1918 | Love | |
| 1,874,326 | A | 8/1932 | Mason | |
| 1,990,837 | A | 2/1935 | Morgenstern | |
| 2,444,910 | A | 7/1948 | Barker | |
| 2,448,593 | A * | 9/1948 | Heising | F41A 21/30 89/14.2 |
| 2,792,760 | A | 5/1957 | Hammer | |
| 3,748,956 | A | 7/1973 | Hubner | |
| 4,576,083 | A | 3/1986 | Seberger, Jr. | |
| 4,588,043 | A | 5/1986 | Finn | |
| 5,029,512 | A | 7/1991 | Latka | |
| 5,679,916 | A | 10/1997 | Weichert | |
| 5,773,746 | A | 6/1998 | Vaden | |
| 6,079,311 | A | 6/2000 | O'Quinn et al. | |
| 6,308,609 | B1 | 10/2001 | Davies | |
| 6,374,718 | B1 | 4/2002 | Rescigno et al. | |
| 6,575,074 | B1 | 6/2003 | Gaddini | |
| 6,899,008 | B2 | 5/2005 | Breuer | |
| 7,237,467 | B1 | 7/2007 | Melton | |
| 7,308,967 | B1 | 12/2007 | Hoel | |
| 7,587,969 | B2 | 9/2009 | Silvers | |
| 7,789,008 | B2 * | 9/2010 | Petersen | F41A 21/30 89/14.4 |
| 7,856,914 | B2 | 12/2010 | Shults et al. | |
| 7,874,238 | B2 * | 1/2011 | Silvers | F41A 21/30 181/223 |
| D651,680 | S | 1/2012 | DeGroat | |
| 8,087,338 | B1 | 1/2012 | Hines | |
| 8,100,224 | B1 | 1/2012 | Olson | |
| 8,162,100 | B2 | 4/2012 | Shults et al. | |
| 8,210,087 | B2 | 7/2012 | Latka | |
| 8,453,789 | B1 * | 6/2013 | Honigmann | F41A 21/30 181/223 |
| 8,459,405 | B1 | 6/2013 | Dueck | |
| 8,459,406 | B1 | 6/2013 | Dueck | |
| 8,474,361 | B2 | 7/2013 | Brittingham | |
| 8,505,680 | B2 | 8/2013 | Dueck | |
| 8,511,425 | B2 | 8/2013 | Larue | |
| 8,528,691 | B1 | 9/2013 | Carmichael et al. | |
| 8,567,556 | B2 | 10/2013 | Dueck et al. | |
| 8,579,075 | B2 | 11/2013 | Brittingham et al. | |
| 8,584,794 | B2 | 11/2013 | Dueck | |
| 8,714,301 | B2 | 5/2014 | Shults | |
| 8,739,922 | B2 | 6/2014 | Wirth et al. | |
| 8,807,005 | B2 | 8/2014 | Moss et al. | |
| 8,844,422 | B1 | 9/2014 | Klett | |
| 8,857,307 | B2 | 10/2014 | Torre et al. | |
| 8,875,612 | B1 | 11/2014 | Klett et al. | |
| 8,910,745 | B2 | 12/2014 | Latka | |
| 8,950,546 | B2 | 2/2015 | Shults et al. | |
| 8,973,481 | B2 | 3/2015 | Dueck et al. | |
| 8,978,818 | B2 | 3/2015 | Proske | |
| 8,991,550 | B2 | 3/2015 | Coley | |
| 8,991,551 | B2 | 3/2015 | Latka | |
| 8,991,552 | B2 | 3/2015 | Latka | |
| 9,097,482 | B1 * | 8/2015 | Holden | F41A 21/30 |
| 9,102,010 | B2 | 8/2015 | Wilson | |
| 2008/0251060 | A1 | 10/2008 | Thurber | |
| 2010/0180759 | A1 * | 7/2010 | Petersen | F41A 21/30 89/14.4 |
| 2011/0297477 | A1 | 12/2011 | Koumbis | |
| 2012/0152093 | A1 | 6/2012 | Koumbis | |
| 2012/0291614 | A1 * | 11/2012 | Koumbis | F41A 21/30 89/14.4 |
| 2014/0020976 | A1 | 1/2014 | Shults | |
| 2014/0157640 | A1 | 6/2014 | Whelan | |
| 2014/0158249 | A1 | 6/2014 | Schlosser | |
| 2014/0224574 | A1 | 8/2014 | Latka | |
| 2014/0224575 | A1 | 8/2014 | Latka | |
| 2014/0237881 | A1 * | 8/2014 | Mack | F41A 21/325 42/90 |
| 2014/0262604 | A1 | 9/2014 | Proske | |
| 2014/0262605 | A1 | 9/2014 | Washburn, III et al. | |
| 2014/0299405 | A1 | 10/2014 | Miller et al. | |
| 2015/0001002 | A1 | 1/2015 | Wirth et al. | |
| 2015/0090105 | A1 * | 4/2015 | Pace | F41A 21/30 89/14.4 |
| 2015/0159971 | A1 | 6/2015 | Salva | |
| 2015/0184968 | A1 | 7/2015 | Fischer et al. | |
| 2015/0226506 | A1 | 8/2015 | Shults et al. | |
| 2015/0338184 | A1 * | 11/2015 | White | F41A 21/30 89/14.4 |
| 2016/0003570 | A1 * | 1/2016 | Tonkin | F41A 21/02 89/14.4 |
| 2017/0191780 | A1 * | 7/2017 | Barrett | F41A 21/325 |

FOREIGN PATENT DOCUMENTS

| | | |
|---|---|---|
| CN | 204373498 | 6/2015 |
| GB | 190814310 | 11/1908 |
| GB | 190900455 | 2/1909 |
| GB | 191024766 | 7/1911 |
| GB | 579168 | 7/1946 |
| RU | 2307991 | 10/2007 |
| RU | 2345305 | 1/2009 |
| WO | 2013057139 | 4/2013 |
| WO | 2014000805 | 1/2014 |
| WO | 2014076356 | 5/2014 |
| WO | 2014076357 | 5/2014 |

OTHER PUBLICATIONS

Bev Fitchett's Guns Magazine—Improvised Weaponry, 'Ram Pipe Cross Sections', Dec. 28, 2015, Atlanta, GA.

uBulletin Solutions, Inc., 'Forum—Community—Off-Topic Discussion—Off-Topic—Suppressor or Silencer', Thread: Suppressor or Silencer. 2014.

* cited by examiner

INTEGRALLY SUPPRESSED BARREL FOR FIREARM

CROSS-REFERENCE TO RELATED APPLICATIONS

The present application is a continuation-in-part of U.S. patent application Ser. No. 14/950,132 filed Nov. 24, 2015, which claims the benefit of priority to U.S. Provisional Application No. 62/096,977 filed Dec. 26, 2014. The foregoing applications are incorporated herein by reference in their entireties.

BACKGROUND OF THE DISCLOSURE

The present disclosure generally relates to firearms, and more particularly to barrels with integral silencers or suppressors which reduce the muzzle noise produced by discharging the firearm.

Silencers or suppressors generally comprise multiple combustion gas expansion chambers in which the high pressure gas is allowed to partially expand prior to leaving the firearm. The projectile such as a bullet is propelled through the barrel of the firearm and silencer by the combustion gas. In an unsuppressed discharge firearm, the rapid expansion and depressurization of the high pressure gas at the muzzle end of the barrel produces a loud sound referred to as muzzle blast or noise. The partial pre-expansion of gas inside the silencer acts to reduce muzzle noise which is desirable in some circumstances.

Silencers are typically configured as separate thread-on assemblies having an outer sleeve and internal sound suppression baffling which are screwed onto the muzzle end of the firearm barrel as a completely removable unit. Some attempts have been made to integrate silencers into the barrel assembly of rifles. However, these units tend to be bulky and cumbersome, thereby creating a barrel assembly that may adversely affect the balance, aiming, and desired slim profile of the barrel and creates a hand held long gun uncharacteristic in dimensions and appearance from a more conventional rifle barrel.

Improvements in integrally suppressed firearm barrels are needed.

SUMMARY OF THE DISCLOSURE

The present invention provides an integrally suppressed barrel for a firearm. In one non-limiting embodiment, the barrel comprises a rear barrel portion defining a breech end and a front barrel portion defining a muzzle end. The silencer components comprises sound suppression baffles arranged in a tubular open ended sleeve of the front barrel portion permanently affixed to and supported by the rear barrel portion of the barrel assembly as a unitary integral part thereof. The baffles have a vertically oblong configuration each including an upper gas expansion chamber aligned with the barrel bore of the rear barrel portion and a lower gas expansion chamber which extends below the barrel's normal cross section and centerline of the bore to provide additional volume for gas expansion, thereby advantageously improving sound suppression performance.

In one embodiment, a barrel adapter is provided which permanently affixes the sleeve to a short rear barrel portion to bring the overall length of the barrel assembly to or above the 16" minimum length required by the ATF (Bureau of Alcohol, Tobacco, Firearms, and Explosive) for a rifle to not be considered a short barreled rifle (SBR). The baffles are stackable and able to slide into the permanently affixed sleeve (or tube). The baffles are secured in the sleeve via an elongated mounting rod such as without limitation a socket head cap screw which threads into the permanently affixed adapter. Removal of the baffles from the sleeve is possible by the fact that the proximal and rearmost baffle inserted in the sleeve (e.g. named a spacer baffle) is threaded to threadably engage the socket head cap screw. By unscrewing the socket head cap screw from the permanently affixed adapter, but not the spacer baffle, the user can pull on the screw to remove all of the baffles at once which collectively form a self-supported baffle unit outside the sleeve. These stackable baffles frictionally press fit together to seal off the combustion gas byproducts generated by firing the firearm from inside the sleeve, thus allowing for much easier removal of the baffles over most integrally suppressed barrel assemblies on the market today by eliminating fouling and carbon buildup on the inner surface of the sleeve.

The integrally suppressed barrel may have a vertically oblong configuration. In one embodiment, the front barrel portion may have a laterally narrow intermediate waist section with a smaller transverse/lateral width than upper and lower portions of the front barrel portion on each side of the waist.

According to one aspect, an integrally suppressed barrel for a firearm includes: a front muzzle end and a rear breech end; a rear barrel portion extending adjacent the breech end, the rear barrel portion having a barrel bore defining a projectile pathway and a longitudinal axis; a front barrel portion extending forward from the rear barrel portion to the muzzle end, the front barrel portion permanently affixed to the rear barrel portion and forming a structurally integral part of the barrel with the rear barrel portion; the front barrel portion including a longitudinal internal passageway comprising a tubular upper longitudinal chamber coaxially aligned with the barrel bore and a tubular lower longitudinal chamber, the upper and lower longitudinal chambers in fluid communication through an intermediate waist section having a transverse width less than a transverse width of the upper and lower longitudinal chambers; a plurality of sound suppression baffles longitudinally stacked in the internal passageway of the front barrel portion, the baffles each comprising an upper gas expansion chamber positioned in the upper longitudinal chamber and a lower gas expansion chamber below the upper gas expansion chamber, the upper and lower gas expansion chambers in fluid communication through a laterally constricted throat section interposed therebetween; wherein when the firearm is discharged, combustion gas flows through the baffles from the upper gas expansion chamber, through the throat section, and into the lower gas expansion chamber of each baffle.

According to another aspect, an integrally suppressed barrel for a firearm includes: a rear barrel portion defining a rear breech end, the rear barrel portion having an axial barrel bore defining a projectile pathway and a longitudinal axis; an axially elongated outer sleeve extending forward from the rear barrel portion and defining a front muzzle end through which a projectile exits the barrel, the sleeve permanently affixed to the rear barrel portion to form a structurally integral part of the barrel with the rear barrel portion; the sleeve defining a longitudinal internal passageway comprising a convexly curved tubular upper section coaxially aligned with the longitudinal axis and coupled to a convexly curved tubular lower section by an intermediate waist section, the lower section offset from the longitudinal axis; a plurality of sound suppression baffles longitudinally stacked in the internal passageway of the sleeve, the baffles each comprising an upper gas expansion chamber coaxially aligned with the longitudinal axis and a lower gas expansion chamber in fluid communication with the upper gas expansion chamber; a front end cap removably retained to the muzzle end; an elongated mounting rod engaging the front end cap and extending through the lower gas expansion chambers of the baffles, the mounting rod having a rear end threadably coupled to the rear barrel portion; wherein when the firearm is discharged, combustion gas flows from the barrel bore and through the baffles from the upper gas expansion chamber to the lower gas expansion chamber of each baffle.

A method for assembling an integrally suppressed barrel for a firearm is provided. The method comprises: providing a rear barrel portion defining an axial bore and longitudinal axis, a hollow outer sleeve permanently affixed to the rear barrel portion to form a structurally integral part of the barrel with the rear barrel portion and having an open distal end, a front end cap, a mounting rod, a spacer baffle, and a plurality of sound suppression primary baffles; releasably attaching a front end of the rod to the front end cap; sliding the plurality of primary baffles onto a threaded rear end of the rod, the primary baffles abuttingly contacting each other; threadably engaging the spacer baffle with the rear end of the rod by rotating the rod, wherein a self-supporting baffle unit is formed; sliding the baffle unit into the outer sleeve through the open distal end; and threadably engaging the rear end of the rod with a threaded socket disposed on the rear barrel portion by rotating the rod; wherein the front end cap is secured inside the distal end of the outer sleeve.

BRIEF DESCRIPTION OF THE DRAWINGS

The features of the exemplary embodiments will be described with reference to the following drawings where like elements are labeled similarly, and in which:

All drawings are schematic and not necessarily to scale. Parts shown and/or given a reference numerical designation in one figure may be considered to be the same parts where they appear in other figures without a numerical designation for brevity unless specifically labeled with a different part number and described herein. References herein to a figure number (e.g. FIG. 1) shall be construed to be a reference to all subpart figures in the group of figures associated with that number (e.g. FIGS. 1A, 1B, etc.), unless otherwise indicated.

DESCRIPTION OF EMBODIMENTS

Figure 1:
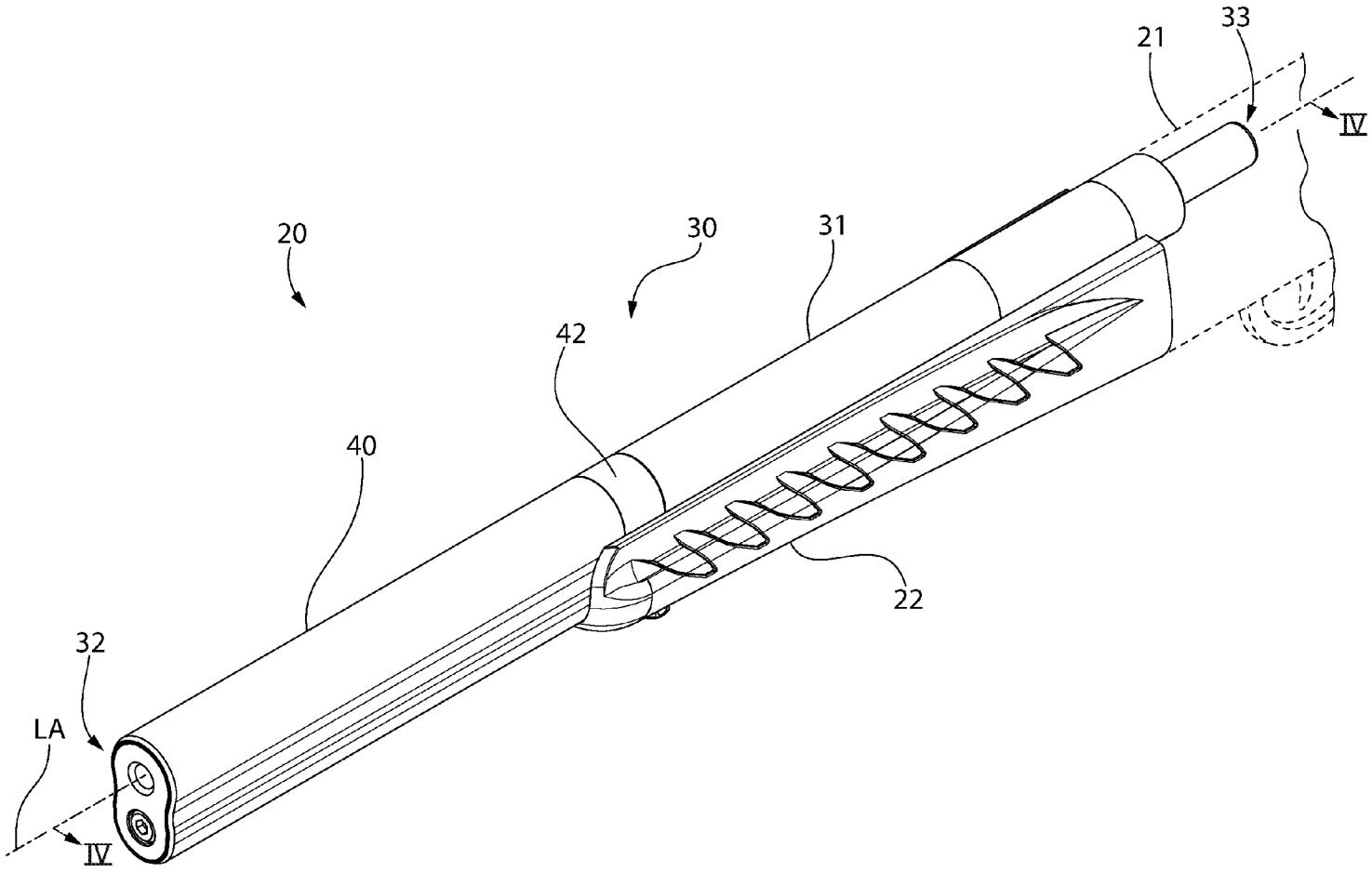
FIG. 1 is a top perspective view of an integrally suppressed barrel for a firearm according to the present disclosure.
Figure 2:
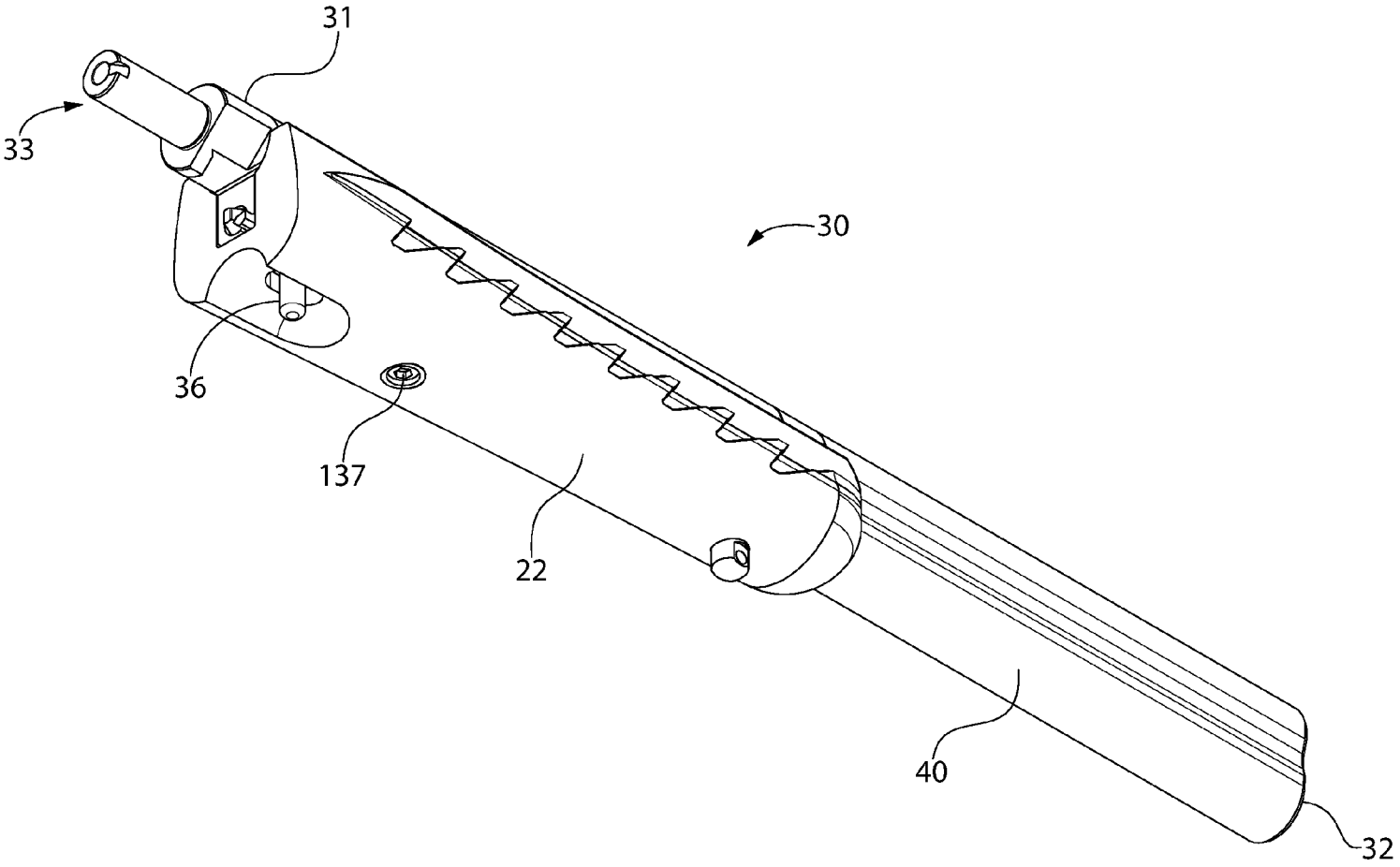
FIG. 2 is a bottom perspective view thereof.
Figure 3:
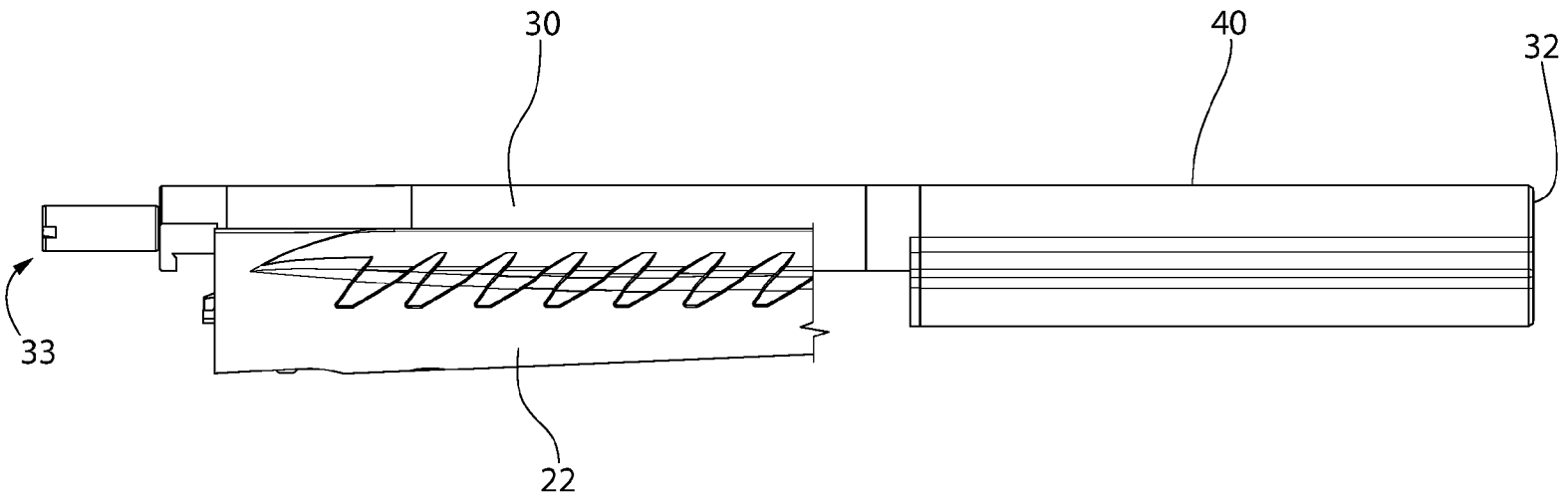
FIG. 3 is a right side elevation view thereof.

The features and benefits of the invention are illustrated and described herein by reference to exemplary embodiments. This description of exemplary embodiments is intended to be read in connection with the accompanying drawings, which are to be considered part of the entire written description. In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," and "interconnected," refer to a relationship wherein structures are secured or attached to one another either directly or indirectly through intervening structures, as well as both movable or rigid attachments or relationships, unless expressly described otherwise. Accordingly, the disclosure expressly should not be limited to such exemplary embodiments illustrating some possible non-limiting combination of features that may exist alone or in other combinations of features.

A non-limiting representative example of a firearm 20 with an integrally suppressed barrel for firearm will now be described with initial reference to FIGS. 1-9. As illustrated, the firearm may be rifle in one embodiment; however, in other embodiments the integrally suppressed barrel may be used in other types of firearms including without limitation shotguns, pistols, and revolvers. Accordingly, the invention is not limited in application to any particular type of firearm.

Firearm 20 generally includes a receiver 21 for housing trigger-actuated firing mechanism components for discharging the rifle, and a barrel assembly 30 supported by the receiver. A forward portion of the rifle stock defines an elongated forend 22 that provides a handguard for grasping and balancing the barrel portion of the rifle. Forend 22 may be mounted to and supported by the barrel assembly 30 at least in part via threaded fasteners 137 or other attachment methods. The forend may partially enclose and circumscribe at least a portion of the length of the barrel assembly as illustrated in one non-limiting configuration. Forend 22 has a generally U-shaped transverse cross section in one embodiment to complement the arcuately curved and round cross sectional shape of the barrel assembly 30 which is cradled therein. The forend may be made of any suitable material, including wood and plastics.

The barrel assembly 30 includes a top 37, bottom 38, an open front muzzle end 32, an open rear breech end 33, and a longitudinal barrel bore 34 extending between the ends. The bore 34 defines a projectile pathway and a longitudinal axis LA coinciding with the centerline of the bore. A transverse or lateral direction or orientation is defined as being perpendicularly or obliquely angled to the longitudinal axis for convenience of description. The breech end 33 is configured for mounting to the receiver 21 by any suitable method, including for example without limitation a threaded connection, barrel locking lugs, a slip-fit pinned connection, or a rotary coupling as illustrated including a latch mechanism 36 for a barrel assembly of a takedown type rifle as illustrated herein. The mounting method does not limit the invention. The latch mechanism 36 if provided may include an axially slideable cylindrical latch pin 140 with an operating lever 146 for moving the pin forward and rearward. Pin 140 engages a complementary shaped hole in the front of the receiver. A mounting block 147 threadably or otherwise affixed to the bottom of the barrel assembly 30 houses pin and lever.

With continuing reference to FIGS. 1-9, barrel assembly 30 is comprised of two main components: a standard rear barrel portion 31 which defines the rear breech end 33 and a front barrel portion 40 which defines the muzzle end 32. The barrel assembly 30 has an overall length L1 which is preferably at least or above the 16 inch minimum barrel length required by the ATF (Bureau of Alcohol, Tobacco, Firearms, and Explosives) under the National Firearms Act to not be considered a short barreled rifle (SBR) subject to corresponding NFA regulations. In such an embodiment to avoid creating an unduly long and heavy barrel, the rear barrel portion 31 may have a length L2 less than the 16 inch AFT minimum, and the front barrel portion 40 makes up the difference and has a length L3 which is sufficient to bring the overall barrel assembly length to 16 inches or above. In order for the front barrel portion 40 to be considered an integral part of the "barrel" for ATF measurement purposes, the front barrel portion is permanently affixed or connected to the rear barrel portion 31 in the factory in a manner which does not permit disassembly by the end user without destroying the barrel. After integration, the front barrel portion forms a structurally integral part with the rear barrel portion 31 as required by the ATF rules. Any suitable ATF compliant permanent fixation method may be used. Per the ATF, a permanent attachment can be accomplished via three different methods: cross-pinning into a blind hole and welding the head of the pin, high temperature silver soldering of the components, and lastly circumferentially welding of the assembly.

In a preferred but non-limiting embodiment, the front barrel portion 40 is permanently cross pinned and welded to the rear barrel portion 33 via a non-removable cross pin 35 inserted through lateral holes 123 in sleeve 41. One hole 123 is a through hole and the other hole is a blind hole. Accordingly, after the pin is installed in the factory, the end user cannot drive the pin with a punch or otherwise disassemble the pinned connection without cutting the barrel assembly. Use of the term "permanent" with respect to the fixation method means that the front barrel portion cannot be separated from the rear barrel portion without physically altering or destructively disturbing the ATF compliant permanent connection between the barrel portions using undue force such as for example cutting, driving cross pins out of their bore, or similar measures.

Front barrel portion 40 includes an axially elongated outer tube or sleeve 21 extending parallel to longitudinal axis LA, a plurality of horizontally stacked baffles including a rearmost spacer baffle 50 and plurality of primary baffles 70 removably inserted in the sleeve, a barrel adapter 42 mounted to barrel portion 31 of the barrel assembly 30, and a distal front end cap 43 removably attached to the sleeve at the muzzle end 32 of the barrel assembly. The proximal or rear end 45 of the front barrel portion 40 is defined as the end which mounts on the front end 39 of the rear barrel portion 33 and receives a projectile therethrough from the barrel bore 34 while the distal or muzzle end 32 of the front barrel portion is defined as the opposite end through which the projectile exits the front barrel portion when the firearm is fired.

FIGS. 11A-E depict the outer sleeve 41 alone in greater detail. Referring to these figures and FIGS. 1-9, the outer sleeve 41 has a hollow tubular body including longitudinally-extending opposing sidewalls 100 that define a rear or proximal end 101 ("proximal end" for brevity), a front or distal end 102 ("distal end" for brevity), and a longitudinal internal passageway 46 extending axially between the ends. The ends 101 and 102 may be fully open in one embodiment without any flanges or other inwardly or outwardly radially extending protrusions which simplifies manufacture of the sleeve. The interior surface of the sleeve (e.g. sidewalls 54) may be generally smooth from end to end to allow the stack of baffles to readily slide and be fully inserted into the sleeve. The outer surface 29 of the sleeve 41 may be solid in structure (i.e. free of through holes or apertures) and generally plain in one embodiment. In some embodiments, a front sight may optionally be mounted on the sleeve.

Sleeve 41 is vertically elongated and oblong in transverse cross section in one embodiment including arcuately curved convex upper and lower sections 103 and 104 separated and joined by a concave intermediate waist section 49. In one configuration, the waist 49 may preferably be constricted and narrower in transverse/lateral maximum width W2 than the maximum width W1 of the upper and lower sections 103, 104. In other possible embodiments, waist section 49 may have the width W2 as the width W1 of the upper and lower sections. In cross section, the sleeve 41 therefore generally has a vertically stacked double tubular configuration as both the upper and lower sections each have a tubular shape in three dimensions.

The maximum height H2 of the sleeve 41 (and front barrel portion 40) is preferably greater than the maximum width W1 to maintain a small cross sectional profile to facilitate aiming, carrying, and storing the firearm in addition to aesthetic reasons. In various embodiments, height H2 is preferably is at least 1.5 times the width W1, and more preferably at least 1.8 times width W1. In one embodiment, the width W2 of the waist section 49 is 0.8 time width W1 or less. The narrow waist section 49 may be formed by opposing longitudinally-extending concave recesses 106 in the outer surfaces of the opposing sidewalls 100. On the interior surface of the sleeve 41 adjoining each recess 106, a pair of inwardly and longitudinally-extending opposing protrusions 105 are formed in the internal passageway 46 (best shown in FIGS. 11C-D). When the baffles 50, 70 are mounted in the sleeve 41, this supports the baffles and maintains proper orientation of the baffles which resists twisting about the longitudinal axis LA when the firearm is discharged or the front barrel portion is assembled. Advantageously, this further eliminates the need for two baffle mounting rods as in some designs to prevent baffle twist.

In one embodiment, the front barrel portion 40 therefore has a corresponding overall vertically oblong shape in transverse cross section (see, e.g. FIGS. 7, 9, and 11A-D showing sleeve 41). The front barrel portion may be considered to have a generally "peanut shaped" cross sectional and front end view configuration, which is created by the shape of the outer sleeve 41 described above. The shape of the sleeve and front barrel portion may be symmetrical in cross section or front end view in one embodiment. Besides the outer sleeve 41, the baffles 50 and 70, front end cap 43, and rear barrel adapter 42 accordingly all have a matching transverse oblong cross sectional shape with narrowed waist which combine to create the overall vertically oblong shape of the front barrel portion 40. The upper section 103 of the sleeve 41 preferably has a complementary shape and size to the rear barrel portion 31 of the barrel assembly 30 to provide a smooth transition therebetween for both aesthetic and line of sight purposes to facilitate aiming the firearm. The outer radius of the top of the upper section 103 therefore preferably coincides with that of the rear barrel portion 31.

In one embodiment, the front barrel portion 40 has a smoothly contoured and non-polygonal profile in front profile as illustrated. In other possible embodiments, the front barrel portion may have an at least partially angular or polygonal shaped profile.

Referring to FIGS. 1-9, the longitudinal internal passageway 46 of the front barrel portion 40 includes a tubular upper longitudinal chamber 47 through which the projectile (e.g. bullet/slug) travels and a tubular lower longitudinal chamber 48. The lower and upper chambers are in fluid communication through the internally open narrow intermediate waist section 49 of the sleeve 41 (and baffles 50, 70). The upper chamber 47 is therefore essentially a continuation of the barrel bore 34 in rear barrel portion 31 for purposes of the projectile path and coaxially aligned with the bore and longitudinal axis LA. The lower chamber 48 is parallel to and below the upper chamber. Waist section 49 has a transverse width W2 (measured between the sidewalls) which is less than the transverse width W1 of the upper and lower chambers 47, 48 (measured between the sidewalls) corresponding to the upper and lower sections 103, 104 of sleeve 41.

The lower chamber 48 creates additional volume for gas expansion and sound suppression when the baffles are disposed therein. Accordingly, front barrel portion 40 preferably has a maximum height H2 which is less than maximum height H1 of the rear barrel portion 31 mounted to the receiver 21. In operation, combustion gases generated by discharging rifle 20 flow from the bore 34 of the rear barrel portion 31 into the upper chamber 47 of front barrel portion 41 and travel forward through the front barrel portion toward muzzle end 32. As the gas travels axially through the series of baffles 50 and 70, a portion of the gases diverge from the longitudinal gas flow path and flow downwards transverse to the longitudinal axis LA through the narrow intermediate waist 49 opening and fill the lower chamber 48, thereby allowing additional expansion of the gas and concomitant suppression of the muzzle blast.

The internal passageway 46 of the sleeve 21 and particularly the central bores or apertures of baffles 50, 70 collectively define an upper projectile pathway P through the front barrel portion 40 which extends along the longitudinal axis LA in a direction from the proximal end 101 to distal end 102 of the outer sleeve 41. Pathway P is shown as a directional arrow to indicate the direction followed by a projectile from the barrel bore 34 when the firearm is discharged.

The barrel adapter 42 is configured and constructed to facilitate permanently mounting the adapter and sleeve 41 to the rear barrel portion 31 of the barrel assembly 30 in one of the ATF compliant methods described herein to create an overall barrel assembly length that meets or exceeds the ATF minimum barrel length requirements for non-short barreled rifles. Barrel adapter 42 is shown in further detail in FIGS. 10A-E. Referring to these figures and FIGS. 1-9, the barrel adapter 42 includes a front end 112, rear end 113, upper section 110, and lower section 111 joined by a narrow waist section 114 therebetween. The upper and lower sections 110, 111 may be tubular in shape having a complementary configuration to the rear portions of the upper and lower sections 103, 104 of the outer sleeve 41. An internal through passage 115 extends between the ends of the upper section 110 defining a projectile pathway which is coaxially aligned with barrel bore 34 and longitudinal axis LA. The lower section 111 includes a front recess 116 and rear recess 117 separated by a division wall 119 which defines a threaded socket 118. Mating threaded rear end 121 of baffle mounting rod 44 screws into socket 118 to rotatably and removably couple the rod to the adapter for mounting the baffles 50, 70, as further described herein.

To create a permanent ATF qualifying coupling and integrated structure as described above, a laterally extending smooth bore 120 is formed through the sidewalls of the barrel adapter 42 which receives a cross pin 35. Cross pin 35 extends transversely through the bore 120 and a concentrically aligned laterally extending smooth bore 122 in the rear barrel portion 31 of barrel assembly 30 to secure the pin 35 in place, thereby locking the barrel adapter 42 to the rear barrel portion. This is a first step.

To complete the permanently joined ATF qualifying assembly, the rear end of the sleeve 41 is in turn permanently mounted to the barrel adapter 42 such as via any suitable ATF compliant permanent joining method already described herein. In one embodiment, sleeve 41 is pinned to the barrel adapter 42 using cross pin 35 which is insertably driven through a pair of transversely spaced apart laterally open holes 123 in the sidewalls in rear end of the sleeve 41 (see, e.g. FIGS. 11A, B, and E). One hole 123 extends completely through the sidewalls of the sleeve and the opposing hole 123 is a blind hole as required by the ATF having an inside open end and an outer closed bottom that does not penetrate the sidewall. The blind hole is accessible only from the interior of the sleeve to the cross pin 35. One installed, the pin 35 is welded to the sleeve 41 and cannot be removed. In one embodiment, the end of the pin may be ground and is preferably flush with the outer surface of the sleeve 41. Because of the far side blind hole 123, a punch is precluded from being used to attempt drive the pin back out and break the weld. Other permanent ATF compliant methods of attaching the barrel adapter 42 and sleeve 41 to the rear barrel portion 31 as already described herein may be used in other embodiments. The method used does not limit the invention.

Figure 10A:
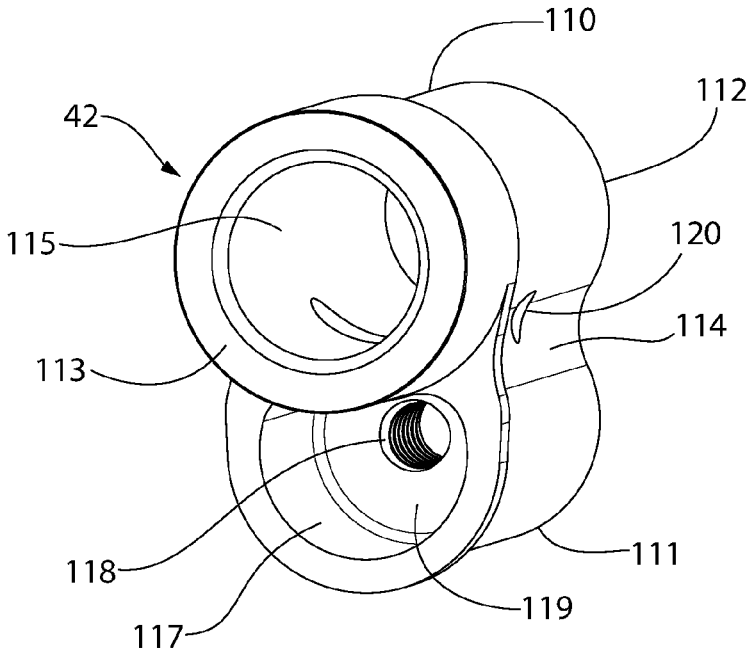
FIG. 10A is a rear perspective view of the barrel adapter of the integrally suppressed barrel of FIG. 1.
Figure 10B:
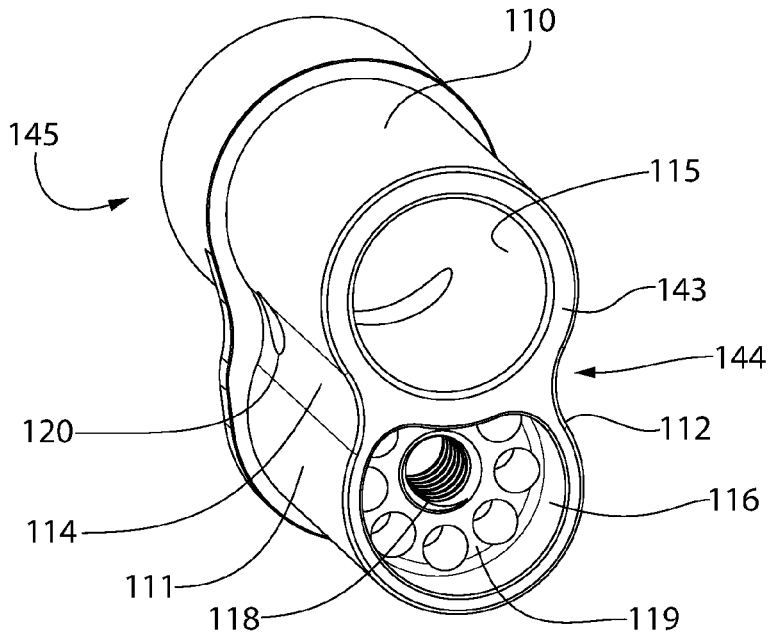
FIG. 10B is a front perspective view thereof.
Figure 10C:
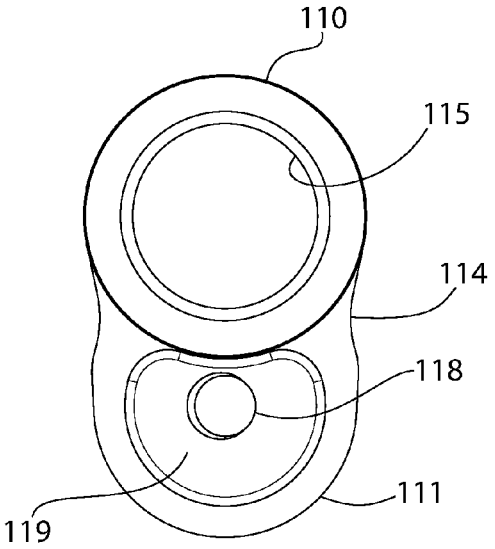
FIG. 10C is a rear end view thereof.
Figure 10D:
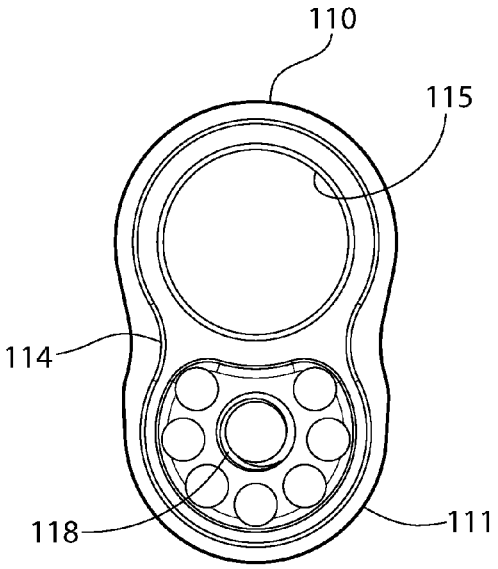
FIG. 10D is a front end view thereof.
Figure 10E:
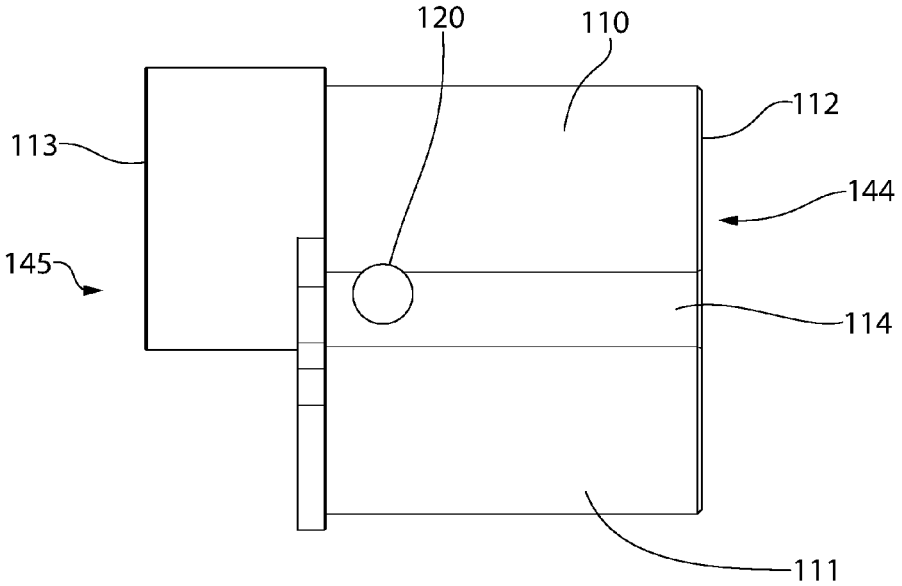
FIG. 10E is a right side view thereof.
Figure 11A:
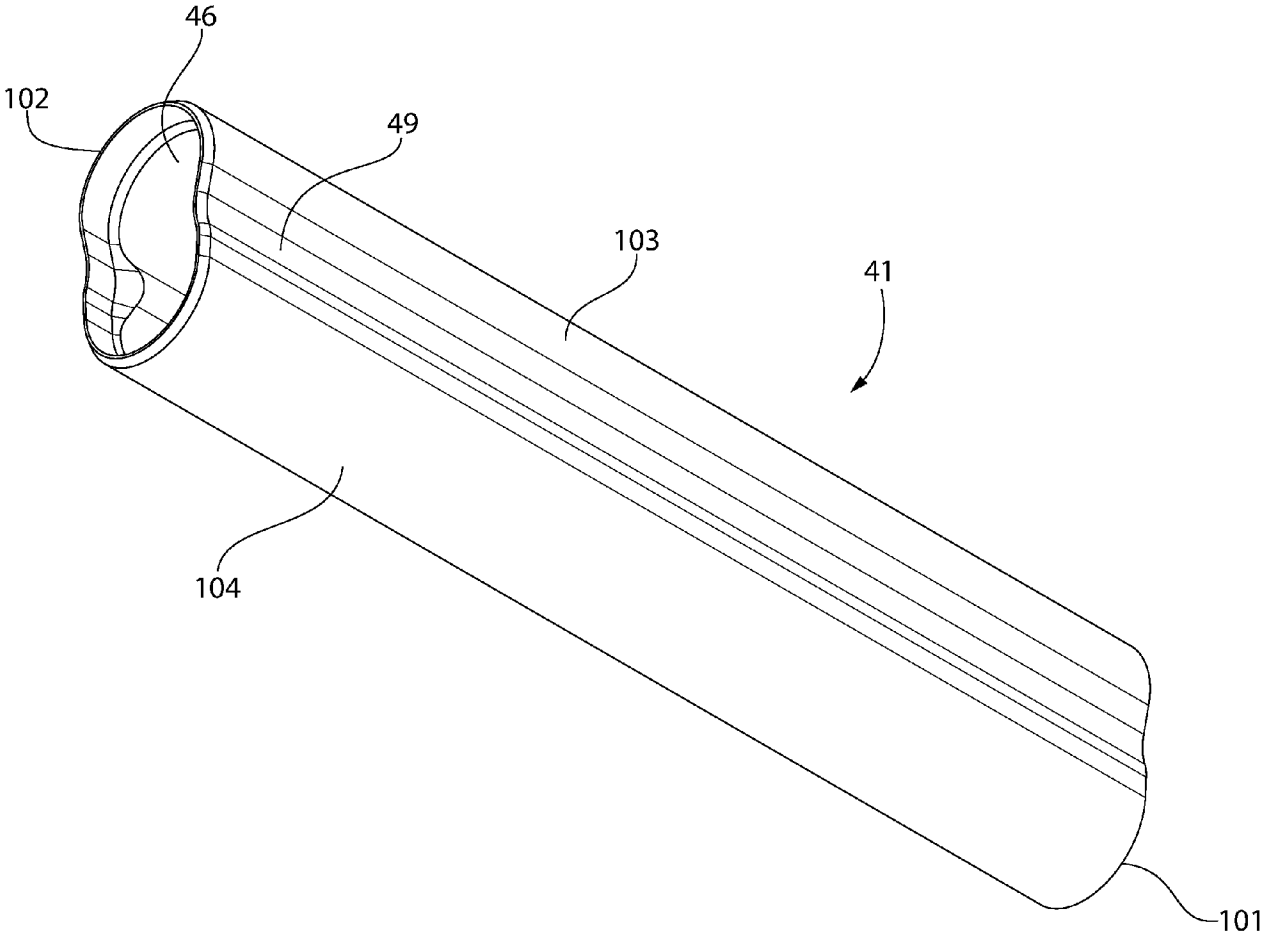
FIG. 11A is a bottom perspective view of the outer sleeve of the integrally suppressed barrel of FIG. 1.
Figure 11B:
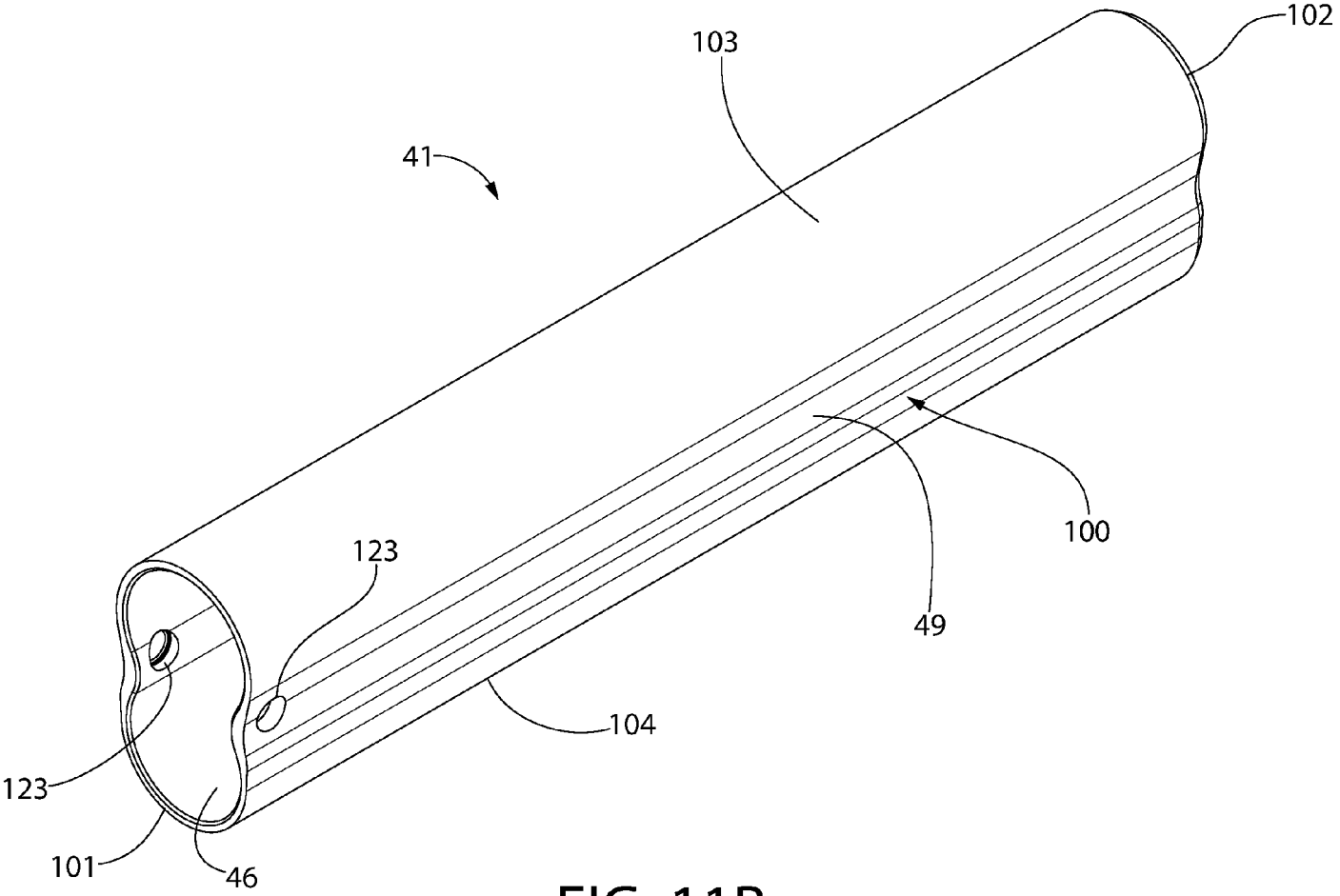
FIG. 11B is a top perspective view thereof.
Figure 11C:
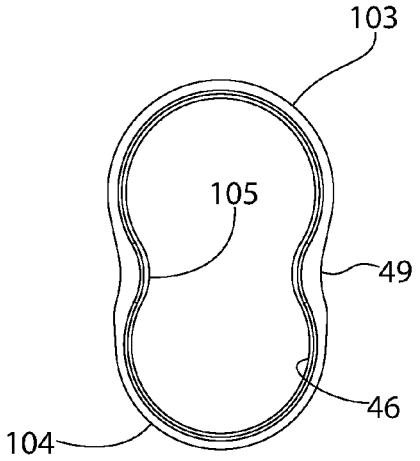
FIG. 11C is a rear end view thereof.
Figure 11D:
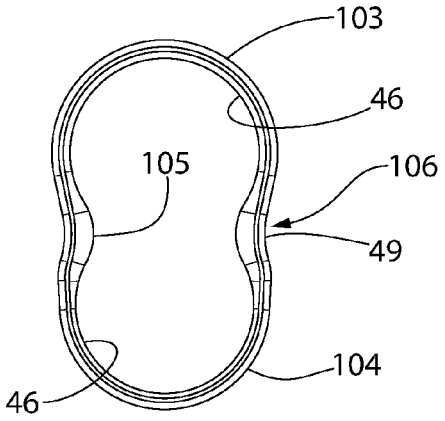
FIG. 11D is a front end view thereof.
Figure 11E:
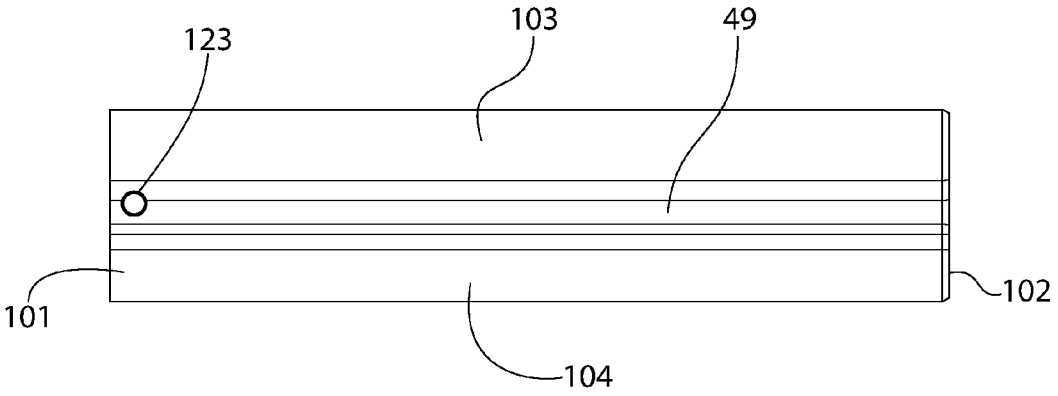
FIG. 11E is a right side view thereof.
Figure 12B:
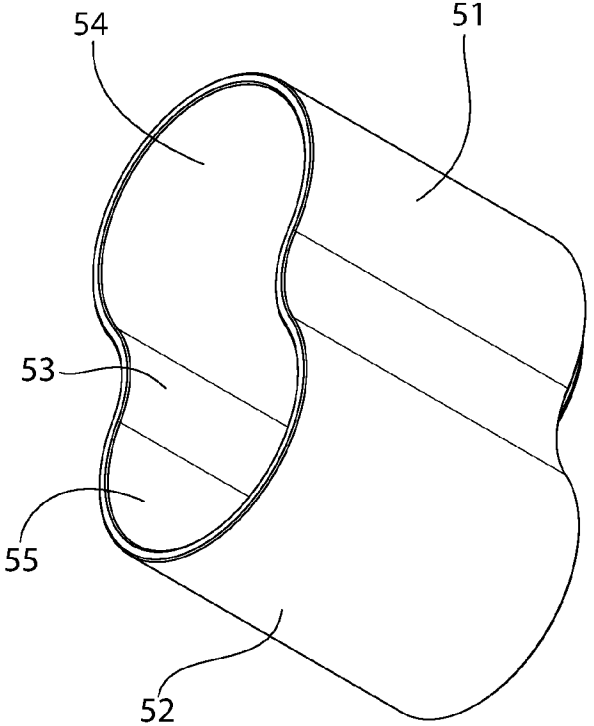
FIG. 12B is a front perspective view thereof.
Figure 12A:
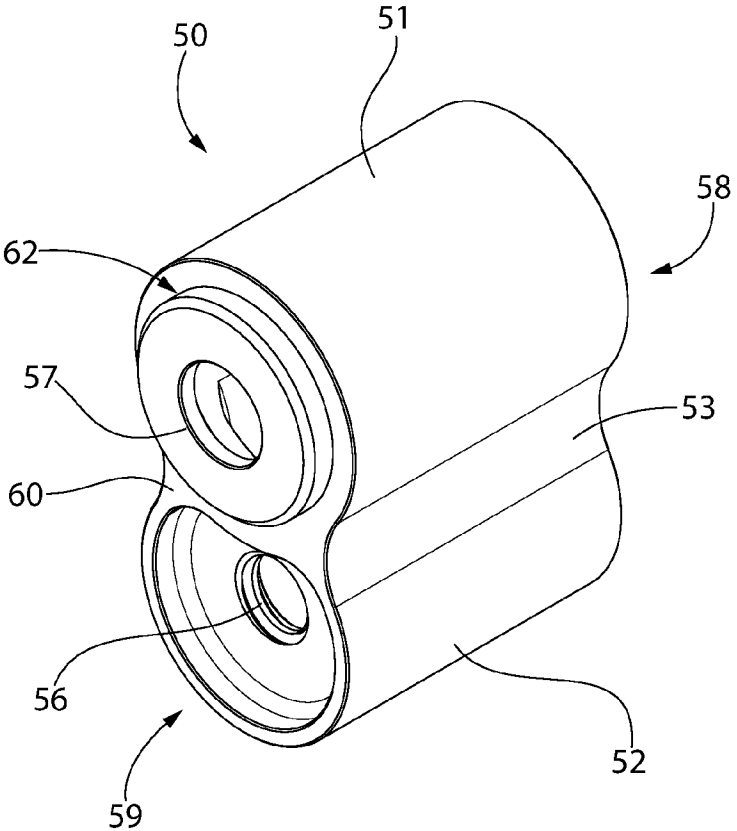
FIG. 12A is a rear perspective view of a spacer baffle of the integrally suppressed barrel of FIG. 1.
Figure 12D:
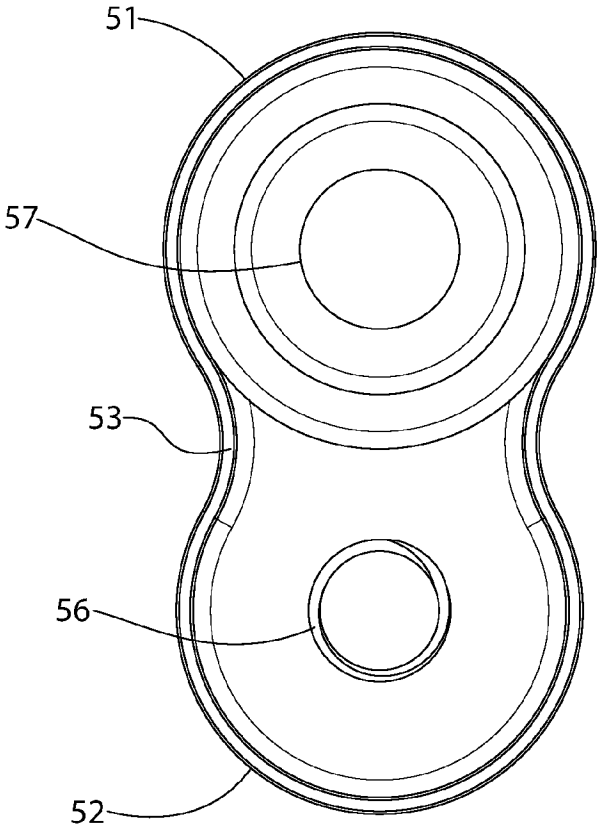
FIG. 12D is a rear end view thereof.
Figure 12C:
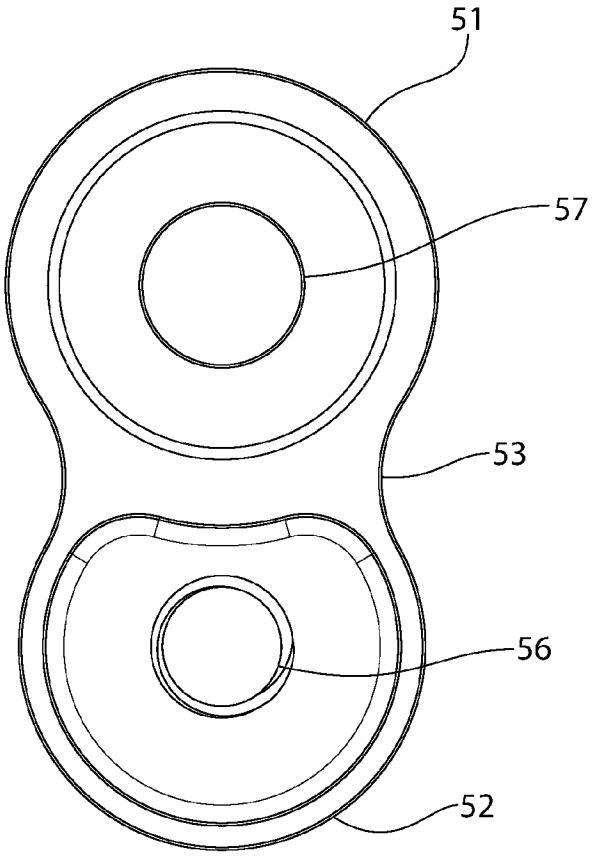
FIG. 12C is front end view thereof.
Figure 12E:
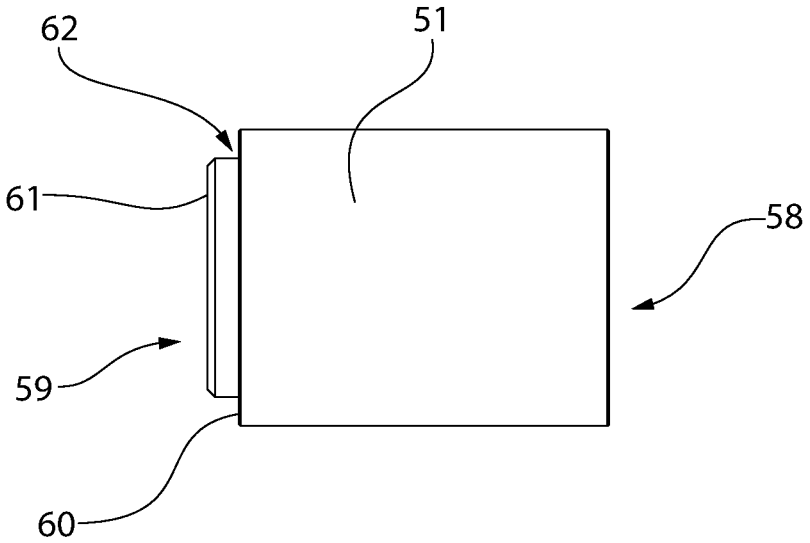
FIG. 12E is a top plan view thereof.
Figure 12F:
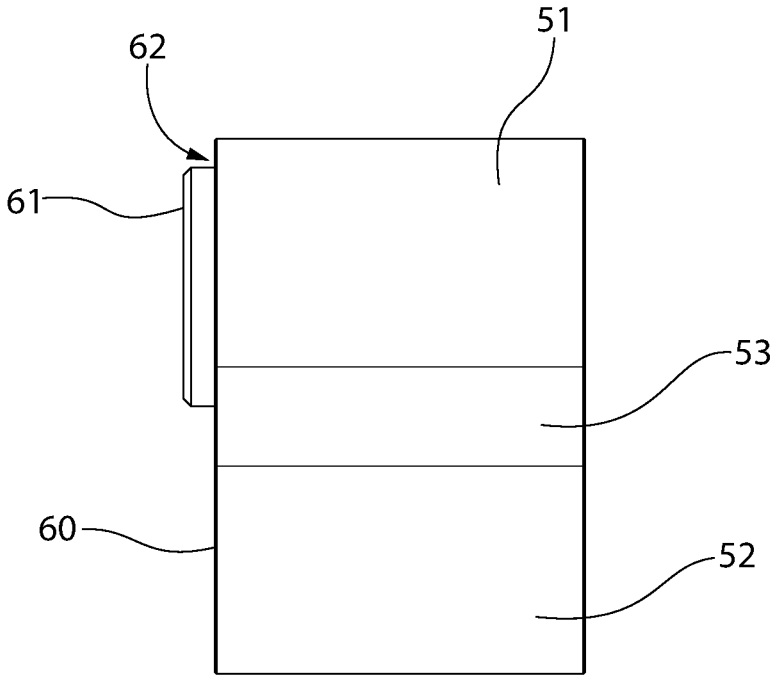
FIG. 12F is a right side view thereof.
Figure 12G:
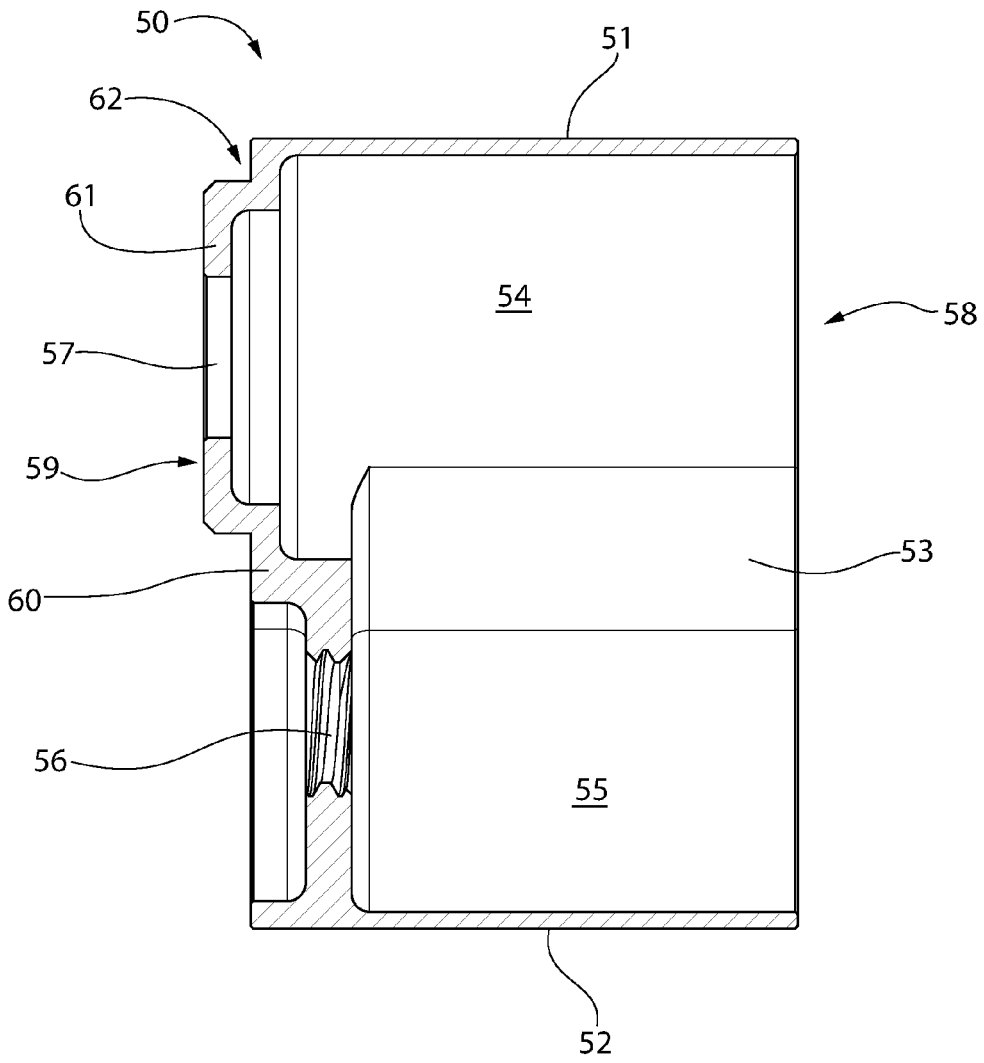
FIG. 12G is a right side cross sectional view thereof.
Figure 13B:
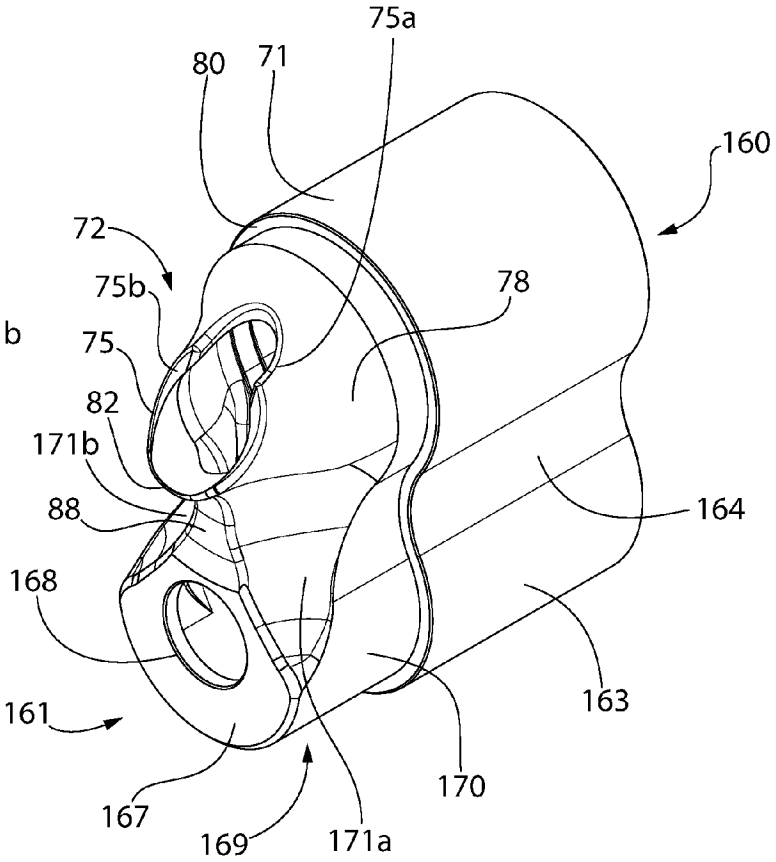
FIG. 13B is a rear perspective view thereof.
Figure 13A:
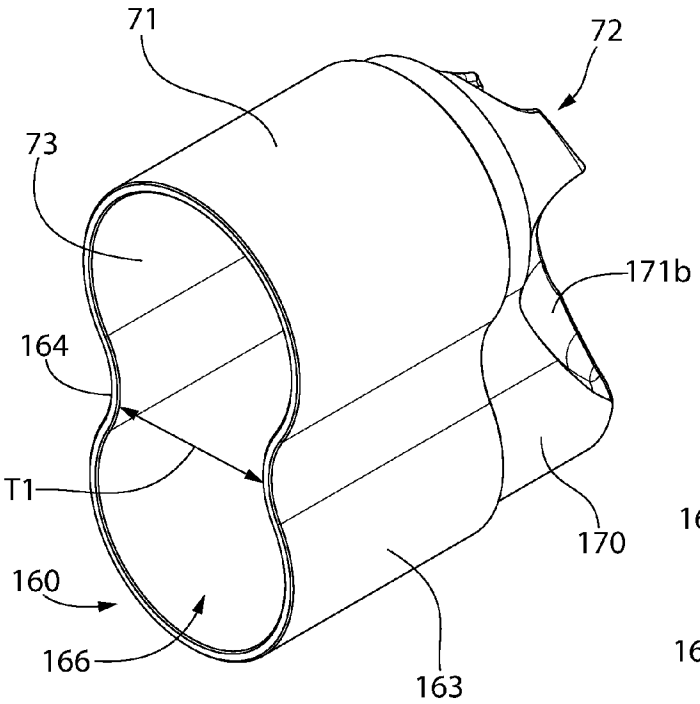
FIG. 13A is a front perspective view of the primary sound suppression baffles of the integrally suppressed barrel of FIG. 1.
Figure 13D:
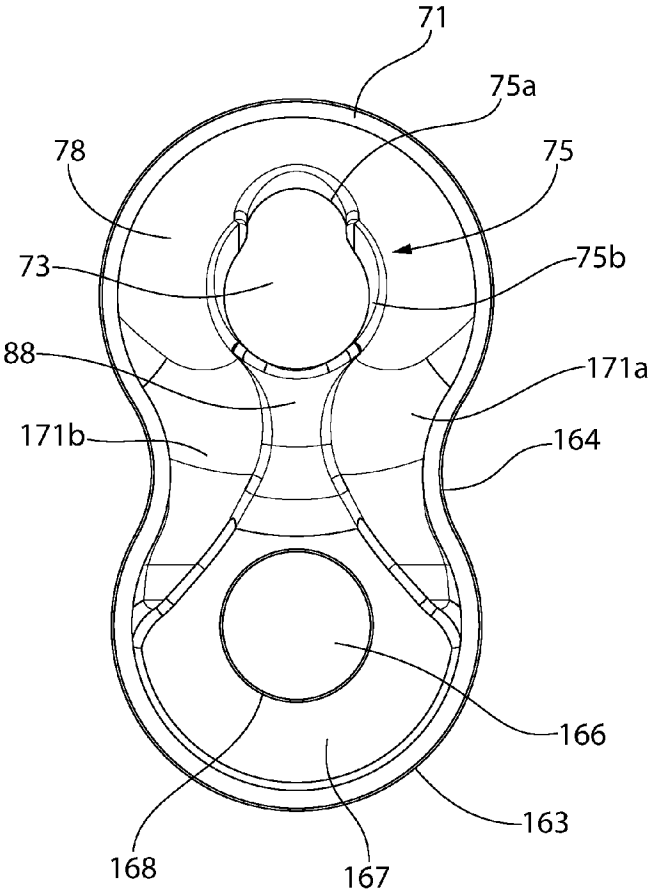
FIG. 13D is a rear end view thereof.
Figure 13C:
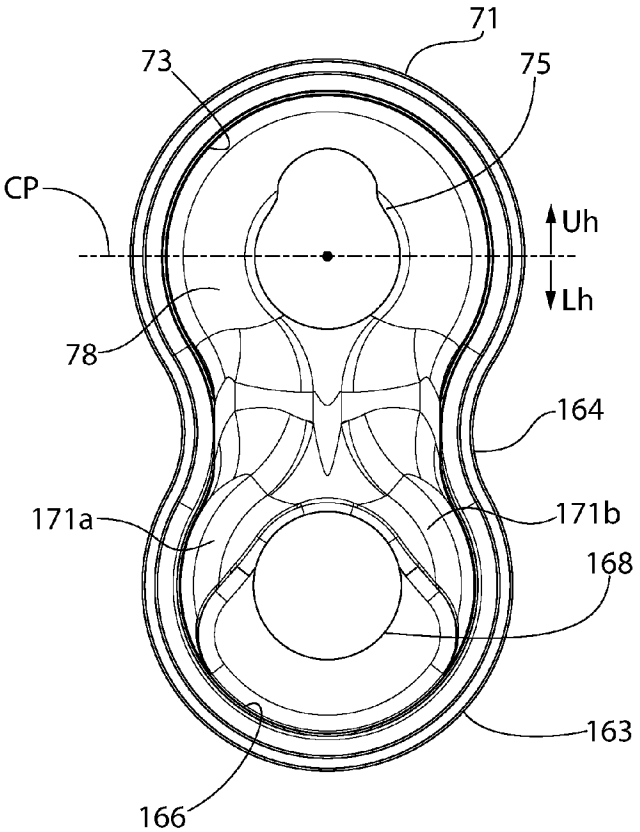
FIG. 13C is a front end view thereof.
Figure 13E:
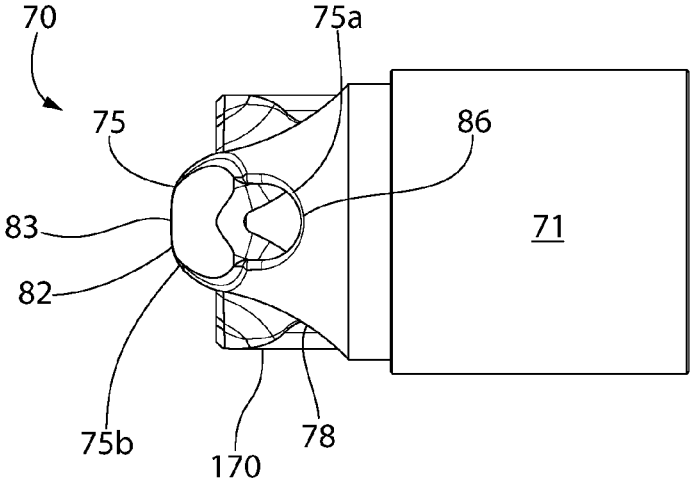
FIG. 13E is a top plan view thereof.
Figure 13F:
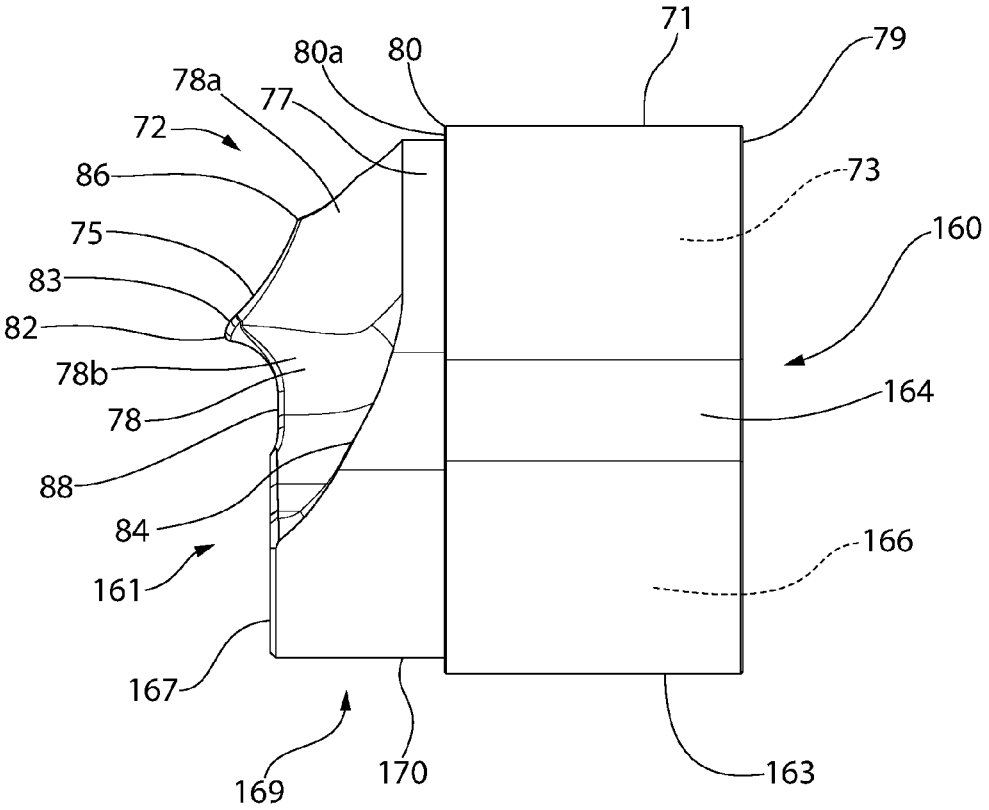
FIG. 13F is a right side view thereof.
Figure 13G:
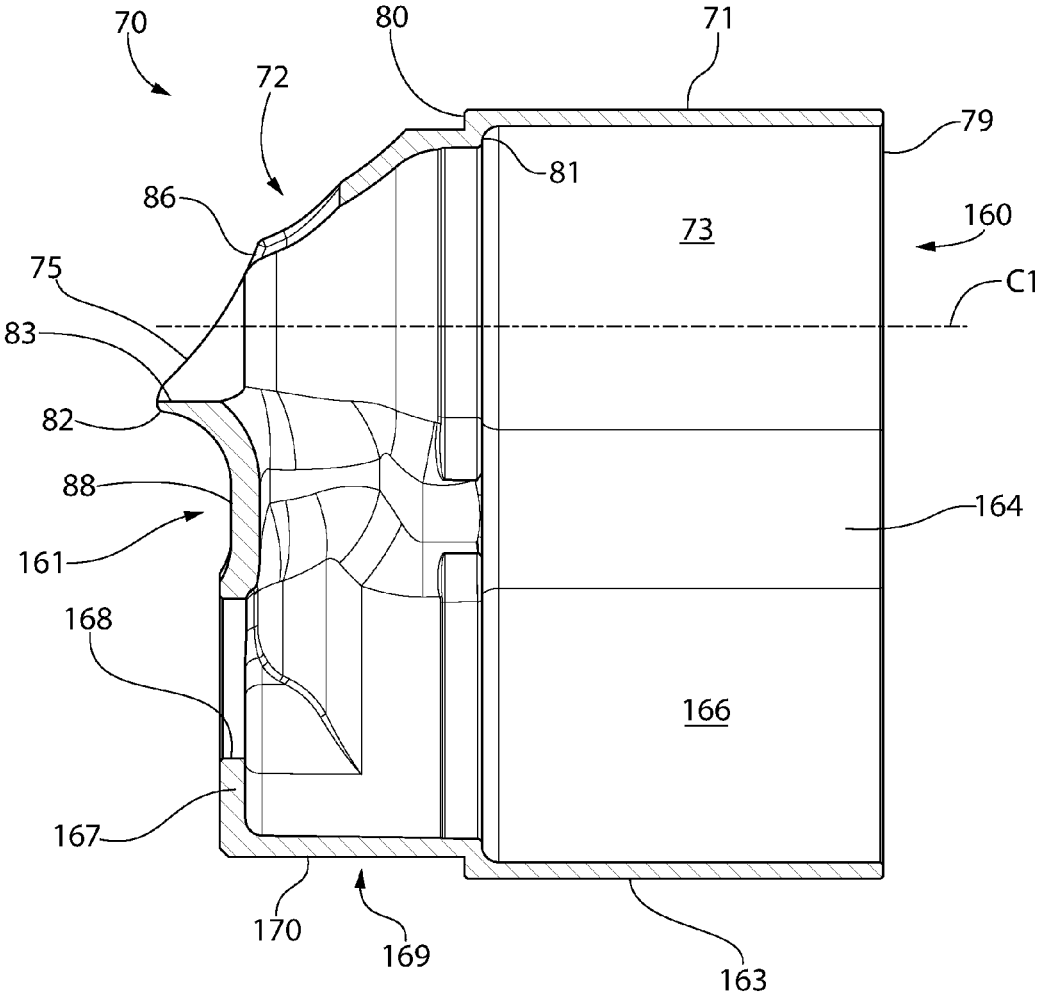
FIG. 13G is a right side cross sectional view thereof.

With additional reference to FIGS. 10A-C, the distal front end cap 43 is generally vertically oblong in shape and has a plate-shaped body comprising front end 130 and opposite rear end 131. End cap 43 includes a vertical end wall 132 with a forwardly open recessed receptacle 135 at the bottom of which is lower aperture 133 for receiving baffle mounting rod 44 therethrough. An enlarged head 136 of the mounting rod is received in the receptacle, thereby flushly mounting the head with the front end 130 of the end cap 43. The head 136 may have a hex shaped or other shaped tool socket 172 which opens forward for receiving a complementary configured end of a tool therein (e.g. hex key, screwdriver, etc.) for rotating the mounting rod when securing the baffle assembly inside the barrel. In one embodiment, receptacle 135 may be formed in a tubular extension extending rearwards from end wall 132 of the end cap.

An upper exit aperture 134 in front end cap 43 is in fluid communication with the internal passageway 46 of the front barrel portion 40. Aperture 134 is sized to allow a fired projectile such as a bullet or slug to pass therethrough. Exit aperture 134 is coaxially and concentrically aligned with the longitudinal axis LA and barrel bore 34. In one non-limiting embodiment, the exit aperture 35 continues and opens rearward into a tubular extension disposed in passageway 46 inside the end cap 43. The tubular extension 34 may be integrally formed with end wall 38 in one embodiment and extends rearwardly from the wall towards the breech end 33 of barrel assembly 30.

In one embodiment, front end cap 43 further includes a rear facing raised lip 141 protruding rearwards from a rear surface of the end cap. The lip 141 is configured and dimensioned for insertion into the forward-most baffle 70 (see, e.g. FIGS. 4A and 4B). The raised lip extends around the entire perimeter of the end cap 43 and is spaced slightly inwards from the peripheral edges of the cap (best shown in FIGS. 14B and 14C) to create a peripheral shoulder 142 from receiving the front distal end 102 of the outer sleeve 41. The shoulder 142 abuttingly engages the forward-most baffle 70, thereby helping secure the baffles in place and apply a compressive force to the stack of baffles 50, 70 when the baffle mounting rod 44 is tightened.

Mounting rod 44 (best shown in FIGS. 4A-B and 9) is axially elongated having a smooth shaft 137 which extends from the front end cap 43 through the stack of baffles 50 and 70, and into the rear mounting adapter 42. In one embodiment, mounting rod 44 may be in the form of a cap screw with threaded rear end 121, long shaft 44, and front diametrically enlarged head 136 having a forward facing tool recess accessible when the baffle assembly is installed in the front barrel portion 40 for rotating the rod. In other embodiments, different methods may be used for securing the baffles in the front barrel portion of the barrel assembly 30. Mounting rod 44 preferably has an axial length (measured along the longitudinal axis LA) which is longer than the assembled length of the stacked baffles, for reasons which will become evident.

For created a flush and smooth transition between the outer sleeve 41, barrel adapter 42, and rear barrel portion 31 of the barrel assembly 30, a series of stepped shoulder may be provided. The barrel adapter 42 includes a circumferentially extending shoulder 138 on an exterior surface which abuttingly engages the rear end 101 of sleeve 41. Similarly, the front end 39 of rear barrel portion 31 includes a circumferentially extending shoulder 139 on an exterior surface which abuttingly engages the rear end 113 of barrel adapter 42. This arrangement forms a smooth profile and transition between the outer sleeve 41, barrel adapter 42, and rear barrel portion 31.

The rearmost spacer baffle 50 and plurality of primary baffles 70 will next be described.

Referring now to FIGS. 4A-B and 13A-G, spacer baffle 50 generally comprises a vertically stacked dual tubular body including a front end 58, rear end 59, and a tubular upper section 51 coupled to a tubular lower section 52 by a laterally narrow waist section 53 therebetween. Waist section 53 has a smaller width than the upper or lower sections. Upper and lower sections 51, 52 each respectively define a corresponding internal upper gas expansion chamber 54 and lower gas expansion chamber 55 each having a generally tubular configuration and related round cross section corresponding to the baffle body, as illustrated. The upper and lower gas expansion chambers 54, 55 extend from the front end 58 to rear end 59 and through the ends. The narrow waist section 53 is internally open allowing the upper gas expansion chamber 54 to fluidly communicate with the lower gas expansion chamber 55 for transferring a portion of the combustion gases therebetween. The lower gas expansion chamber 55 therefore creates additional internal volume for combustion gas expansion below the upper longitudinal chamber 47 inside the front barrel portion sleeve 41 and the projectile pathway therethrough.

In one embodiment, the rear end 59 of the spacer baffle 50 may include rear wall 60 adjacent to the upper and lower gas expansion chambers 54, 55. The front end 58 may be completely open for receiving a rear portion of the rearmost primary baffle 70 therein as further described herein. A first top rear aperture 57 is formed in the rear wall 60 which fluidly communicates with the upper gas expansion chamber 54. Aperture 57 may be diametrically smaller than the diameter of the upper gas expansion chamber 54 in one configuration. A second rear bottom aperture 56 is formed in the rear wall 60 which fluidly communicates with the lower gas expansion chamber 55 forming a through hole. Aperture 56 may be diametrically smaller than the diameter of the lower gas expansion chamber 55 in one configuration. Aperture 56 may be threaded in one embodiment for rotatably engaging the threaded rear end 121 of the baffle mounting rod 44, as further described herein. Apertures 56 and 57 may each be round. Preferably, the top rear aperture 57 has a diameter at least as large as or larger than the barrel bore 34. Baffle 50 may made of any suitable preferably metallic or non-metallic material.

Spacer baffle 50 has a complementary cross sectional shape to the cross sectional shape of the outer sleeve 41. Preferably, the spacer baffle 50 is sized slightly smaller than the sleeve 41 to allow the baffle to slide therein. When the spacer baffle 50 is installed in the front barrel portion 40 of the barrel assembly 30, the rear wall 60 of the baffle abuttingly engages the front 39 of the rear barrel portion 33 and the top rear aperture 57 becomes concentrically and coaxially aligned with the barrel bore 34 for receiving a projectile therethrough. A portion of the rear wall 60 of the baffle 50 which defines the top rear aperture 57 may form a rear protrusion 61 which extends rearward from the baffle beyond the rear wall adjoining the rear bottom aperture 56. The protrusion 61 defines an annular shoulder 62 which abuttingly engages a mating annular seat 143 on the front end 144 of the barrel adapter (see also FIGS. 4B and 10B). This arrangement helps lock the spacer baffle 50 into correct position against the front end 39 of the rear barrel portion 31 of the barrel assembly 30, thereby creating a close fit.

The primary baffles 70 will now be described with initial reference to FIGS. 4B and 13A-G. In one non-limiting embodiment illustrated herein, baffles 70 may be configured similarly to the skewed cone design disclosed in U.S. patent application Ser. No. 14/950,132 filed Nov. 24, 2015, which is incorporated herein by reference in its entirety. Modifications are made to adapt the baffle for use in the present integrally suppressed barrel design and provide the additional lower gas expansion chambers and new mounting system.

Primary baffles 70 may each be configured similarly and generally comprise a vertically stacked dual tubular body including an front end 160, partially closed rear end 161, and a convexly curved tubular upper section 71 coupled to a convexly curved tubular lower section 163 by an internally open and laterally narrow concave waist section 164 interposed therebetween. Waist section 164 has a smaller lateral/transverse width than the upper or lower sections in a similar manner to the outer sleeve 41 of the front barrel portion 40. Upper and lower sections 71, 163 each respectively define a corresponding internal upper gas expansion chamber 73 and lower gas expansion chamber 166 each having a tubular configuration and related round cross section corresponding to the baffle body, as illustrated. The upper and lower gas expansion chambers 73, 166 extend from the front end 160 to rear end 161 and through the ends. The narrow waist section 164 is internally open allowing the upper gas expansion chamber 73 to fluidly communicate with the lower gas expansion chamber 73 for transferring a portion of the combustion gases therebetween. The waist section 164 defines a laterally constricted throat opening T1 between the upper and lower gas expansion chamber that acts like a converging/diverging-nozzle. The throat opening T1 is smaller in width than the width (i.e. diameter) of the upper and lower gas expansion chambers 73, 166. The lower gas expansion chamber 73 advantageously creates additional internal volume for combustion gas expansion below the upper longitudinal chamber 47 of sleeve 41 and the projectile pathway.

It bears noting that in other possible alternative embodiments, the constriction in waist section 164 may instead be formed by opposing inwardly extending protrusions formed on the interior surface of the baffle 70. In such embodiments, both the waist section 49 of outer sleeve 49 and waist section 164 of baffle 70 may have the same lateral width as the upper and lower sections of the sleeve and baffles forming substantially straight waist sections between their respective sides.

In one embodiment, the rear end 161 of the spacer baffle 50 may include rear wall 167 adjacent to the upper and lower gas expansion chambers 73, 166. The front end 160 may be completely open for receiving a rear portion of the next baffle 70 therein as further described herein. A lower mounting aperture 168 is formed in the rear wall 167 which fluidly communicates with the lower gas expansion chamber 166. Rear wall 167 may be vertically flat in one embodiment which contrasts with the arcuately concave shape of the rear wall concave wall segment 78 surrounding the flat face and central aperture 75. Aperture 168 may be diametrically smaller than the diameter of the lower gas expansion chamber 166 in one configuration. Aperture 168 may have a smooth bore in one embodiment for allowing the baffle mounting rod 44 to slide therethrough, as further described herein. Aperture 168 may be round and sized slightly larger in diameter than the diameter of the mounting rod 44. Baffles 70 may made of any suitable preferably metallic or non-metallic material.

Each primary baffle 70 has a complementary cross sectional shape to the cross sectional shape of the outer sleeve 41 of the front barrel portion 40. Preferably, each baffle 70 is sized slightly smaller than the sleeve 41 to allow the baffle to slide therein. When the plurality of baffles 70 are installed in the front barrel portion 40 of the barrel assembly 30, a portion of the rear wall 167 of the rearmost baffle 70 abuttingly engages the front end 58 of the rear spacer baffle 50.

Primary baffle 70 defines a rear extension 169 that defines rear wall 167 of the baffle body. In one embodiment, the rear extension 169 includes an asymmetrically shaped upper hollow cone 72 protruding rearwardly from the tubular upper section 71 and a partially cylindrical lower portion 170 protruding rearwardly from the tubular lower section 163. Cone 72 is formed by a complexly curved upper portion of the rear wall 167. The interior open upper gas expansion chamber 73 extends rearwards insides the cone 72. Similarly, the interior open lower gas expansion chamber 166 extends rearwards inside lower portion 170. In one embodiment, the cone 72 is formed integrally with the baffle body and tubular upper section 71 of the baffle 70 as a unitary structural part thereof. In other embodiments, the cone may be a separate component attached to sleeve via any suitable means such as welding, brazing, soldering, adhesives, fasteners, etc. in part depending on the material selected for the baffle.

Figure 4A:
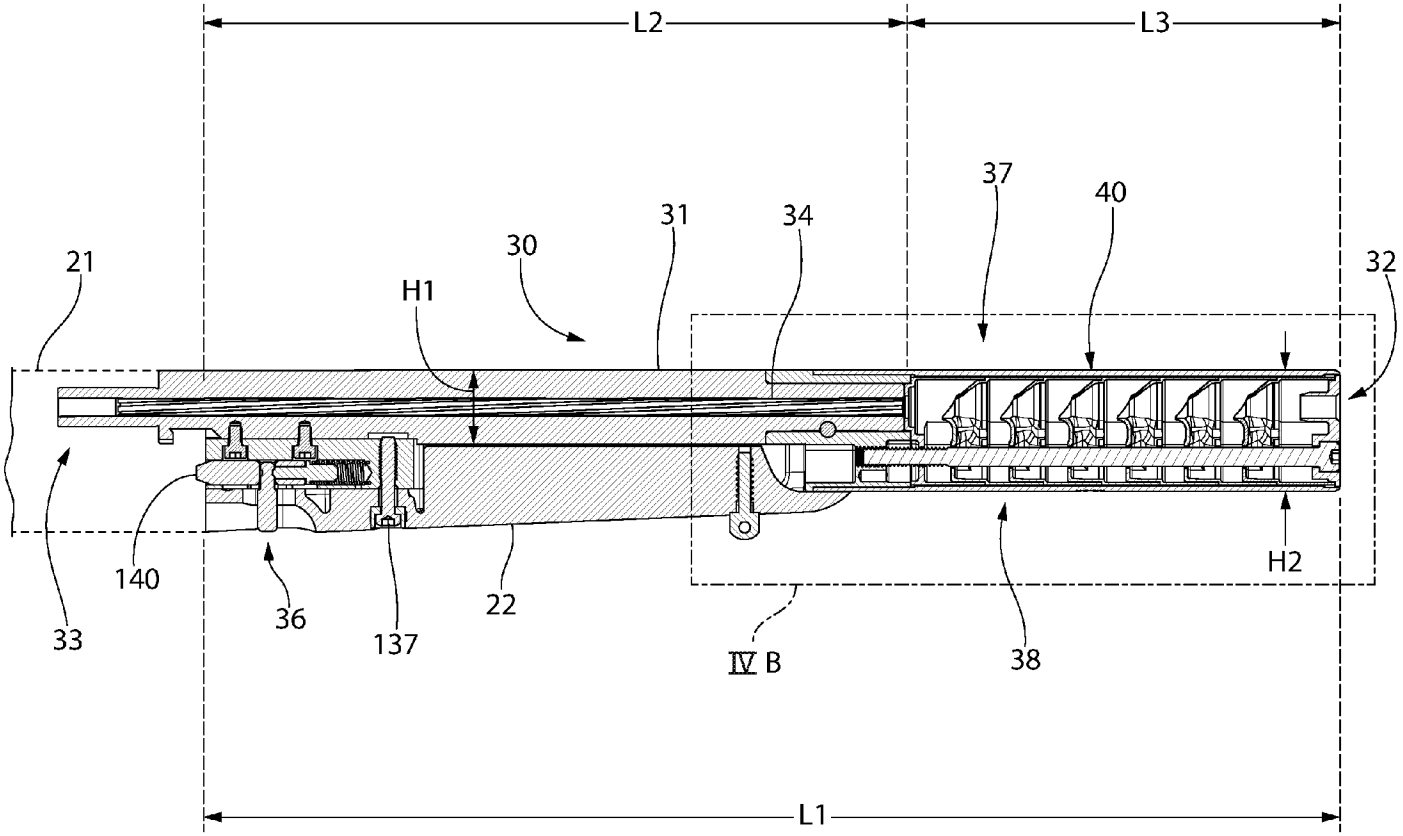
FIG. 4A is a longitudinal cross sectional view thereof.
Figure 4B:
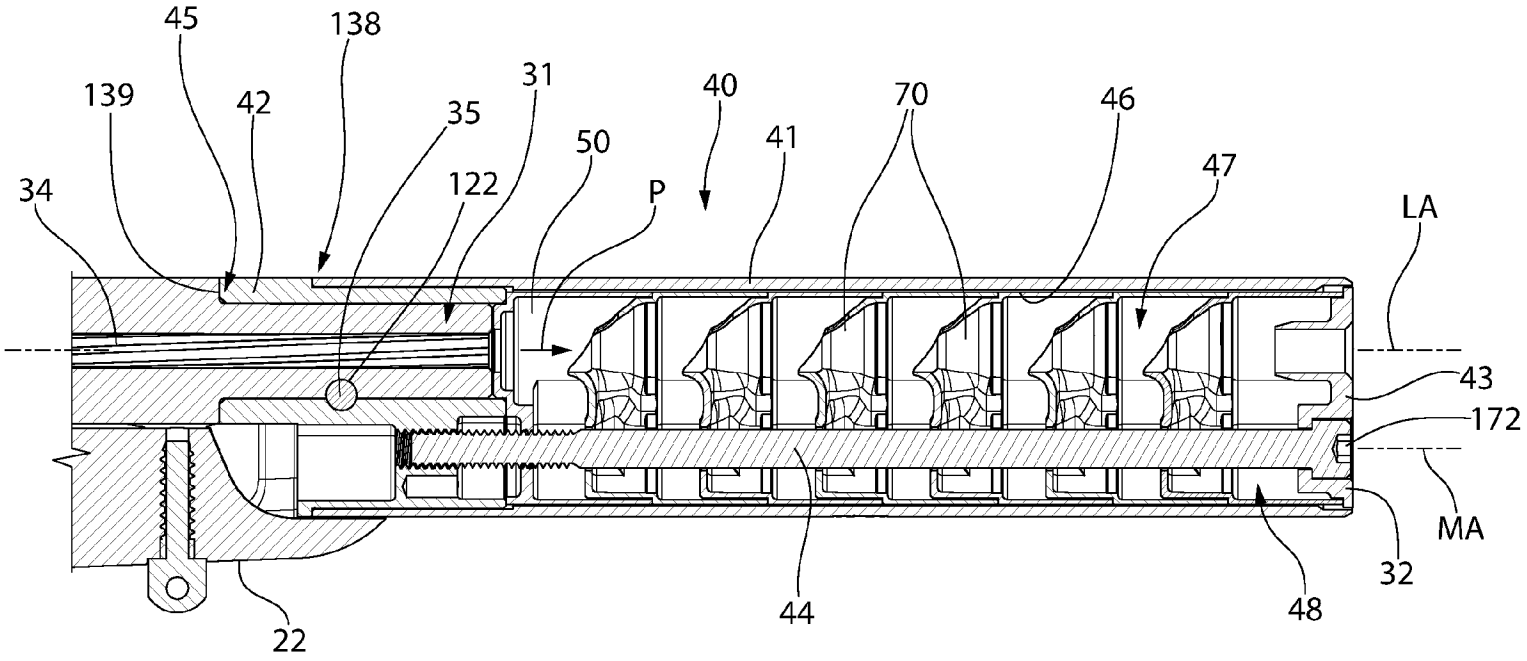
FIG. 4B is a detailed view from FIG. 4A.
Figure 5:
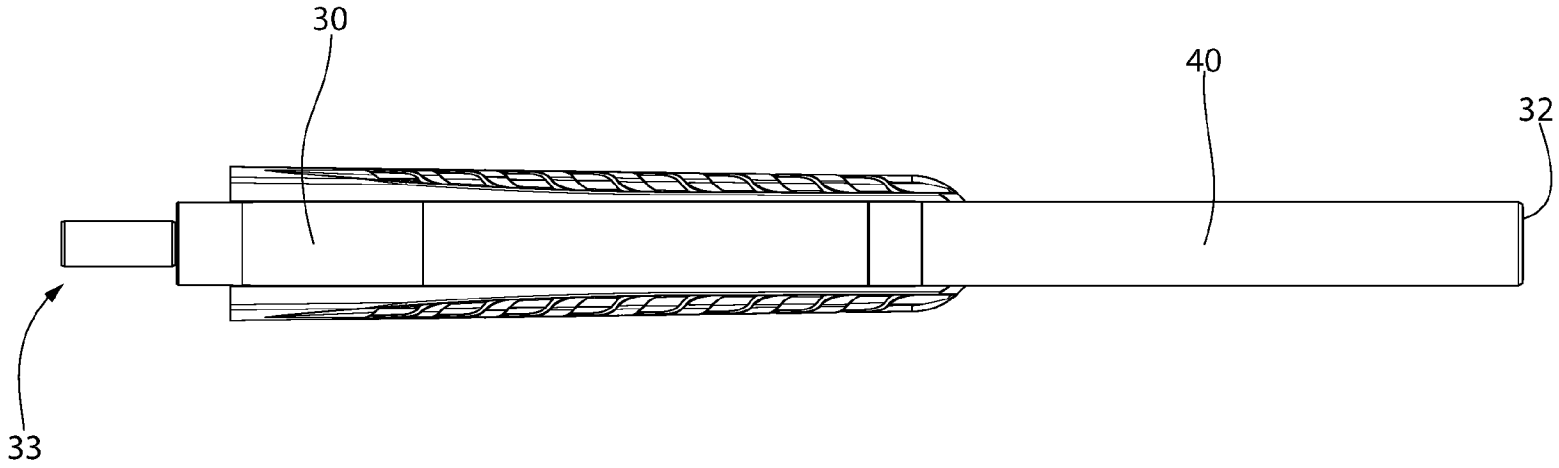
FIG. 5 is a top plan view of the integrally suppressed barrel.
Figure 6:
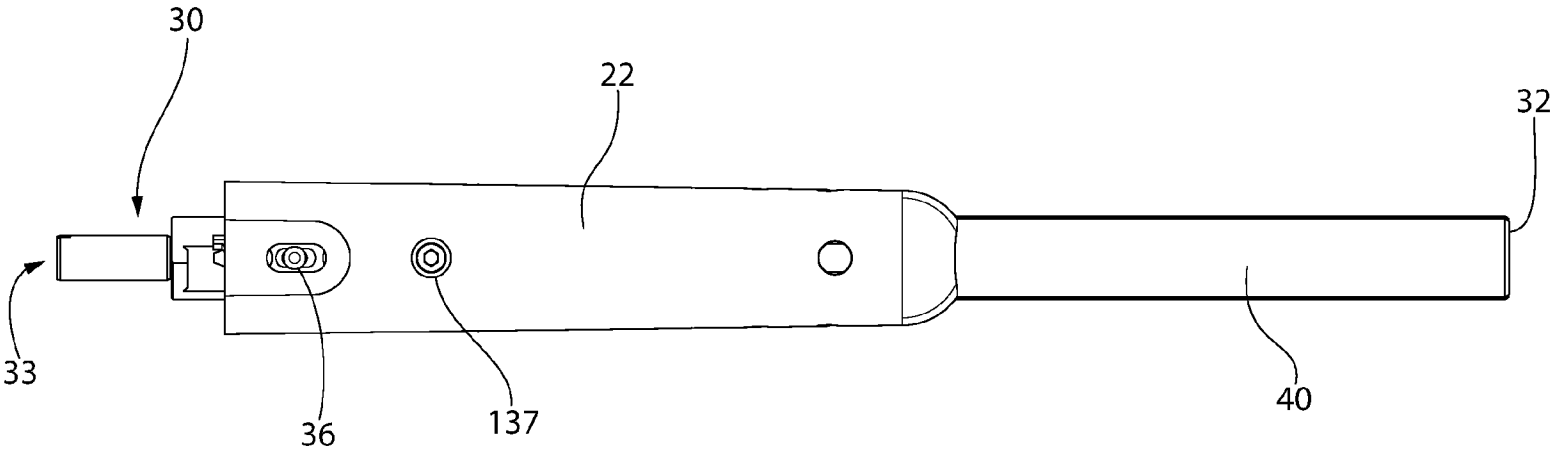
FIG. 6 is a bottom plan view thereof.
Figure 7:
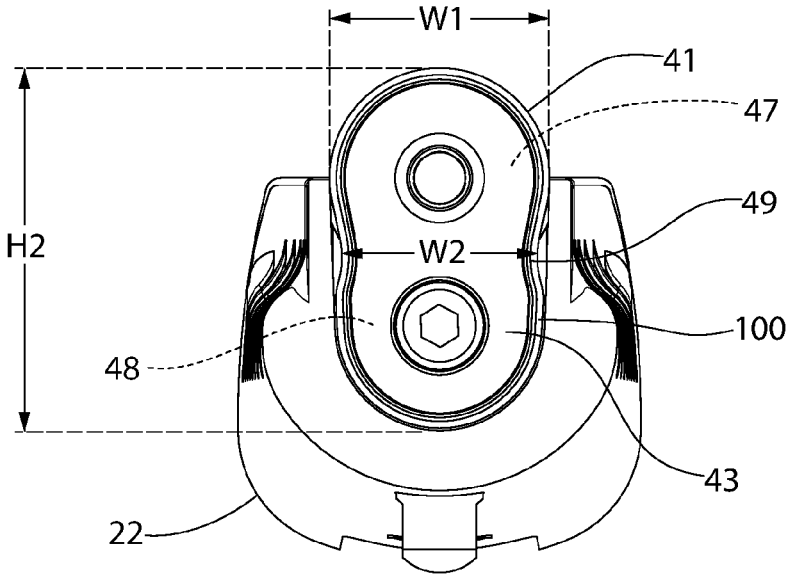
FIG. 7 is front end view thereof.
Figure 8:
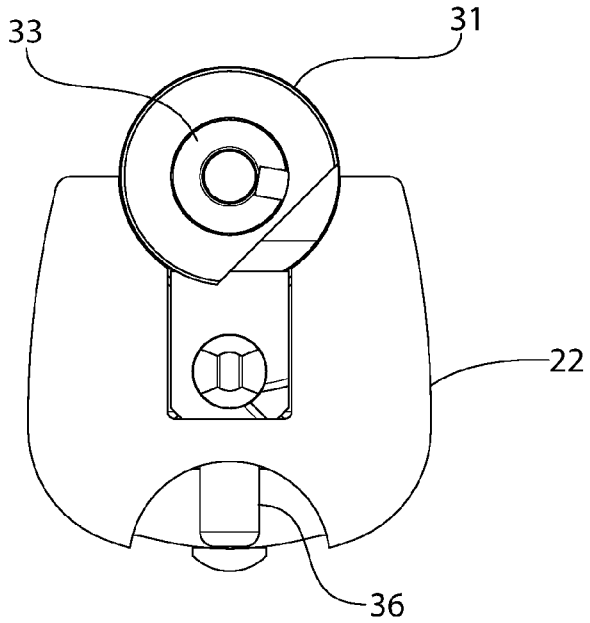
FIG. 8 is a rear end view thereof.

Tubular upper section 71 may define a majority volumetric portion of the forwardly open upper gas expansion chamber 73 in contrast to the open interior of the rear extension 169. Chamber 73 is sized for insertion of the cone 72 of the next adjacent forward primary baffle 70 at least partially therein through open front end 160 of the baffle, as best shown in FIGS. 4A and 4B. The mounting sleeve 71 has a distal edge 79 which defines the front end 74 of the baffle and a proximal edge 80 which adjoins and from which the cone 72 extends axially towards the proximal end 101 of the outer sleeve 41. The distal edge 80 has a stepped configuration in one embodiment forming a shoulder 80*a* at the transition between the rear extension 169 and tubular upper and lower sections 71, 163 of the baffle. Shoulder 80*a* defines a rear facing abutment surface for engaging the proximal edge 79 of the next adjacent rearward primary baffle 70 when the baffle stack is assembled, or in one case of the distal edge 80 of rearmost baffle 80 the abutment surface engages the front end 58 of the spacer baffle 50. The stepped configuration between the rear extension 169 (which defines cone 72 and lower portion 170) and front upper and lower tubular sections 71, 163 slightly recesses the rear extension around its perimeter which forms a frictional press fit into the distal edge 79 of the next rearward adjacent baffle to create a gas tight seal and self-supporting assembled baffle array which does not require the outer sleeve 41 for support outside of the sleeve (see, e.g. FIG. 14). This creates a primary pressure retention boundary or barrier for retaining the combustion gas pressure which does not rely on the secondary pressure retention boundary or barrier formed by the outer sleeve 41. The rearmost primary baffle 70 forms a frictional press fit also with the distal front end 58 of the spacer baffle 50 in a similar manner. Note that press fitting between the primary baffles 70 and spacer baffle 50 collectively create a sealed internal volume to advantageously prevent or minimize gas out-leakage and carbon/lead from building up on the inside of the outer sleeve 41, thereby advantageously reducing maintenance and cleaning.

Cone 72 includes an internally open base end 81 connected to upper section 71 and a free terminal end 82 defining a rear prominence. Cone 72 has a complex asymmetrical and skewed compound shape in one embodiment combining an axially-straight part-cylindrical wall segment 77 extending rearward from upper section 71 and an arcuately curved concave wall segment 78 adjoining wall segment 77. Wall segment 77 has a partial cylindrical configuration (hereafter "partial cylinder wall segment" for brevity) and an axial length shorter than the partially cylindrical lower portion 170 of the rear extension 169 adjoining the lower section 163 of the baffle. The axial length of the wall segment 77 gradually increases along arcuate contour lines 84 formed at a transition between adjoining portions of the partial cylindrical wall segment 77 and concave wall segment 78 moving downward along each of the lateral sides of the cone 72. Accordingly, an arcuate contour line 84 is present on both lateral sides of the cone 72. When positioned in the front barrel portion outer sleeve 41, the partial cylindrical wall segment 77 forms a portion of the entire cone 72 which is disposed adjacent and closest to the interior surface of the outer sleeve 41.

The concave wall segment 78 of cone 72 extends obliquely to and from the axially-straight partial cylindrical wall segment 77. The concave wall segment 78 of cone 72 defines an oblong upper central aperture 75 which receives a projectile therethrough from the barrel bore. Central aperture 75 is coaxially and concentrically aligned with the longitudinal axis LA and barrel bore 34, respectively. Central aperture 75 has a smaller open area than the inside diameter of the open base end 81 of the cone 72. The vertical major axis of central aperture 75 is longer than a horizontal minor axis similar to an ellipse. Preferably, the open area of central aperture 75 presents a rearward projected vertical diameter that matches or is slightly larger than the diameter of the barrel bore 34 to receive a projectile therethrough.

The central aperture 75 of primary baffle 70 is obliquely arranged and oriented to the longitudinal axis LA of the barrel assembly 30 (see, e.g. FIGS. 4A-B). Accordingly, an acute and oblique angle is formed between longitudinal axis LA and the angled plane in which the central aperture 75 substantially lies. Aperture 75 is angled to face generally both rearwards and upwards forming the hood or overhang below the aperture as shown. In operation, the hood of the aperture and concave configuration of the cone 72 encourages a substantial portion of the combustion gasses to spill over the wall of the cone and flow downwards from the upper gas expansion chamber 73 through the narrow waist 164 and into the lower gas expansion chamber 166 of the baffle 70. This path of least resistance creates a strong cross-jetting that slows the progression of the gasses traveling in-line with the central aperture 75 to fill the lower gas expansion chamber. This increases the sound deadening performance of the integrally suppressed barrel.

For an arbitrary reference system to facilitate description, the upper aperture 75 defines a horizontal aperture centerline Cl which defines a horizontal reference plane Cp which includes centerline Cl. Centerline Cl is coaxial with the longitudinal axis LA of the barrel assembly 30 when mounted therein and bisects the tubular upper section 71 into upper and lower halves Uh and Lh. The concave wall segment 78 defines a rear face of the baffle 70 which is divided into a concave upper half section 78*a* defined above the centerline Cl and reference plane Cp, and a concave lower half section 78*b* defined below the centerline Cl and horizontal reference plane Cp. The shape and axial length of the upper and lower half sections is different giving the upper and lower half sections a different side profile as illustrated in the side and side cross-sectional views of the baffle 70. The cone 72 is therefore asymmetrical in shape. The lower half section 78*b* protrudes axially rearward towards rear or proximal end 101 of front barrel portion 40 farther than the upper half section 78*a*. Accordingly, the lower half section 78*b* of the concave wall segment 78 has portions below the terminal end 82 of the baffle 70 which are spaced farther rearward than and apart from the tubular upper section 71 of baffle than any portions of the upper half section 78*a* in the illustrated embodiment.

The upper and lower half portions 78*a*, 78*b* of the concave wall segment 78 collectively define the oblong upper central aperture 75. A rear prominence on the lower half portion 78*b* of the cone concave segment adjacent central aperture 75 defines a leading edge 83 of the aperture and a trailing edge 86 of the aperture is defined by the upper half portion 78*a*. In the orientation of silencer 20 as shown in FIGS. 11F and 11G, the leading edge 83 is a top edge and trailing edge 86 is a bottom edge of central aperture 75. Leading edge 83 projects farther rearward than the trailing edge 86 such that a projectile entering the central aperture 75 from the barrel bore 34 of rear barrel portion 31 after discharging the firearm first encounters the leading edge. The leading edge 83 thus creates a cantilevered hood below the central aperture 75 forcing a portion of the gas not traveling directly through the aperture upwards around the aperture and then downwards along the rear face of the cone towards the lower gas expansion chamber 166. A concavely sloped and double wedge shaped prominent ridge 88 extends downward from the leading edge 83 of central aperture 75 to the lower mounting aperture 168 where concave right and left faces 171*a*, 171*b* of the lower portion 78*b* of concave wall segment 78 meet (see, e.g. FIGS. 13B, 13F, and 13G). Faces 171*a*, 171*b* are on opposite sides of ridge 88 and each may be wedge shaped having a broader top than bottom.

In some embodiments, an upper lower minor portion 75*a* of the central aperture 75 may have a smaller lateral width which is less than the diameter of the barrel bore 34 so that the projectile does not pass through this portion. Conversely, the lower major portion 75*b* of the central aperture 75 having a lateral width larger than the minor portion 75*a* has a lateral width the same as or larger than the barrel bore 34 to allow passage of a projectile therethrough. The upper minor portion 75*a* adds extra open space above the projectile as it is passing through the central aperture 75 to permit combustion gas cross-jetting to initiate simultaneously which enhances sound suppression performance.

The cone 72 of each primary baffle 70 may be considered to be essentially shaped like an asymmetric skewed cone. The axially shorter upper half section 78*a* section of the baffle cone segment 78 is designed to ramp the combustion gas pressure away from and around the central aperture 75 to gather at the lowest point on the upper half section 78*a* of the cone segment against the baffle face. As the combustion gas pressure builds enough to "spill" over the oblong rim of the cone segment that defines the aperture 75 and flows into the aperture through the upper minor portion 75*a*, this causes gas cross-jetting into the next forward baffle upper gas expansion chamber 73.

Cross-jetting is extremely effective at disrupting the high speed combustion gasses traveling along the bore-line (i.e. longitudinal axis LA coaxial with central aperture 75), which if left alone would escape out of the suppressor at high pressures, thus creating a loud report. The gasses need to be slowed down to give them time to expand and cool. The cross-jetting of the rearmost first primary baffle 70 causes the gasses to divert from the bore-line, get caught in the next downstream baffle chamber 110, and then add to the cross-jetting flow of that baffle. Thus, the efficacy of each baffle 70 progressively improves closer to the front distal end 23 of the front barrel portion 40. The asymmetrically skewed shape of the primary baffle 70 encourages this cross-jetting to occur faster than normal cone shapes. It is advantageous for this cross-jetting effect to occur quickly in order to slow as much escaping gas as possible for improving sound suppression.

The primary baffle 70 can be formed by any suitable method. In some fabrication processes, this compound baffle shape may be machined from a single piece of metal bar stock or investment cast to net shape and then finished by appropriate machining techniques. The invention is not limited by the production method(s) used.

Although primary baffles 70 have been described which incorporate the foregoing skewed cone design in the projectile pathway of the sound suppression device, the invention is not limited in its applicability to such baffle configurations alone. In other embodiments, numerous baffle variations and alternative shapes may be used including as some examples without limitation plain baffle apertures in a straight or angled baffle face, symmetrical cone designs on the baffle face, and others. Such other designs may be used in the integrally suppressed barrel system and mounting mechanism with equal benefit.

A method for assembling the barrel assembly 30 will now be generally described. The method described herein is one of several possible sequential approaches for assembling the integrally suppressed barrel. Accordingly, numerous sequential variations are possible and the invention is not limited to any one approach.

Figure 9:
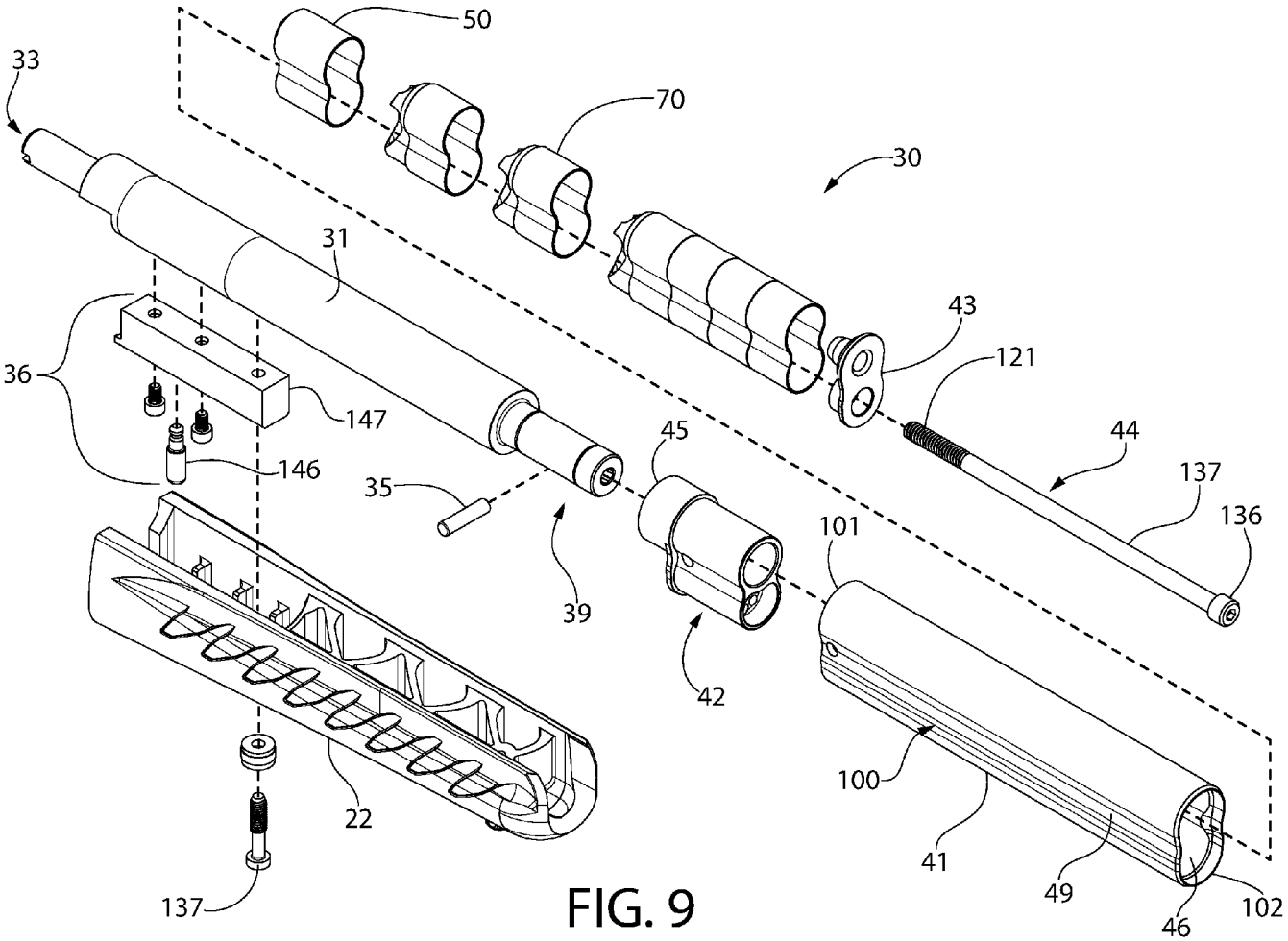
FIG. 9 is an exploded perspective view thereof.

The present method comprises initially providing the following unassembled major components of the integrally suppressed barrel system: the rear barrel portion 31, outer sleeve 41 of front barrel portion 40 a front end cap 43, spacer baffle 50, a plurality of primary baffles 70, rear barrel adapter 42, and baffle mounting rod 44. FIG. 9 shows the baffle mounting system and integrally suppressed barrel in a disassembled condition for reference.

The barrel adapter 42 is permanently installed on the front end 39 of the rear barrel portion 31 of barrel assembly 30 as an initial step (if not already installed) using the cross-pinning method already described herein or an alternative permanent fixation method. The outer sleeve 41 is then permanently affixed to the barrel adapter 42 (if not already done so before fixing the adapter to rear barrel portion 31) using any of the permanent fixation methods described above. The mounted outer sleeve is now prepared and ready for installing the baffles.

Figure 14A:
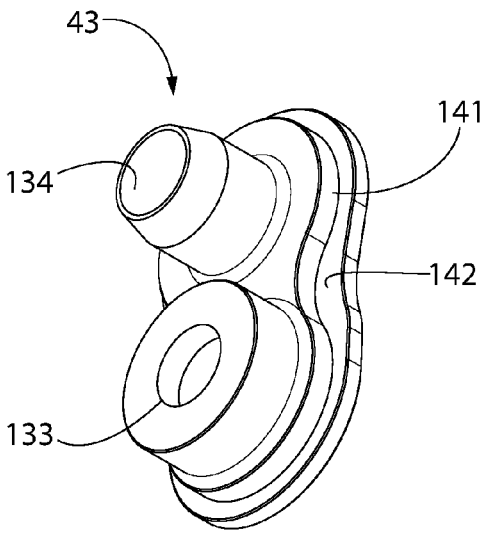
FIG. 14A is a rear perspective view of the front end cap of the integrally suppressed barrel of FIG. 1.
Figure 14B:
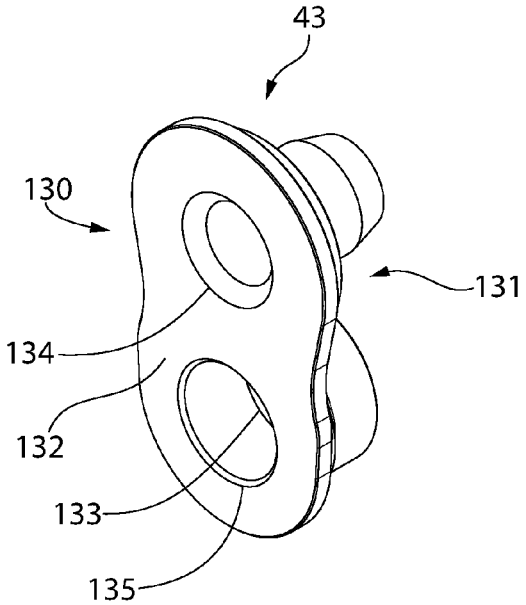
FIG. 14B is a front perspective view thereof.
Figure 14C:
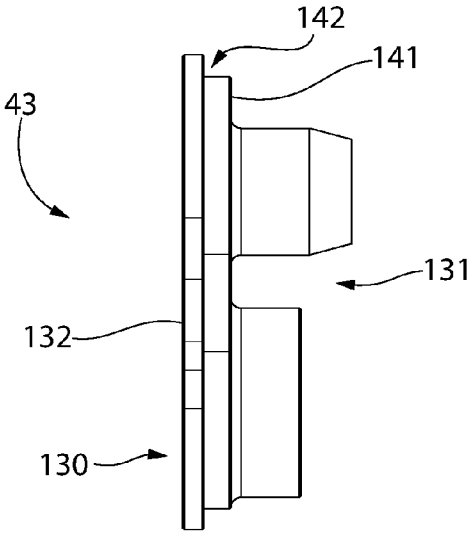
FIG. 14C is a left side view thereof.
Figure 15:
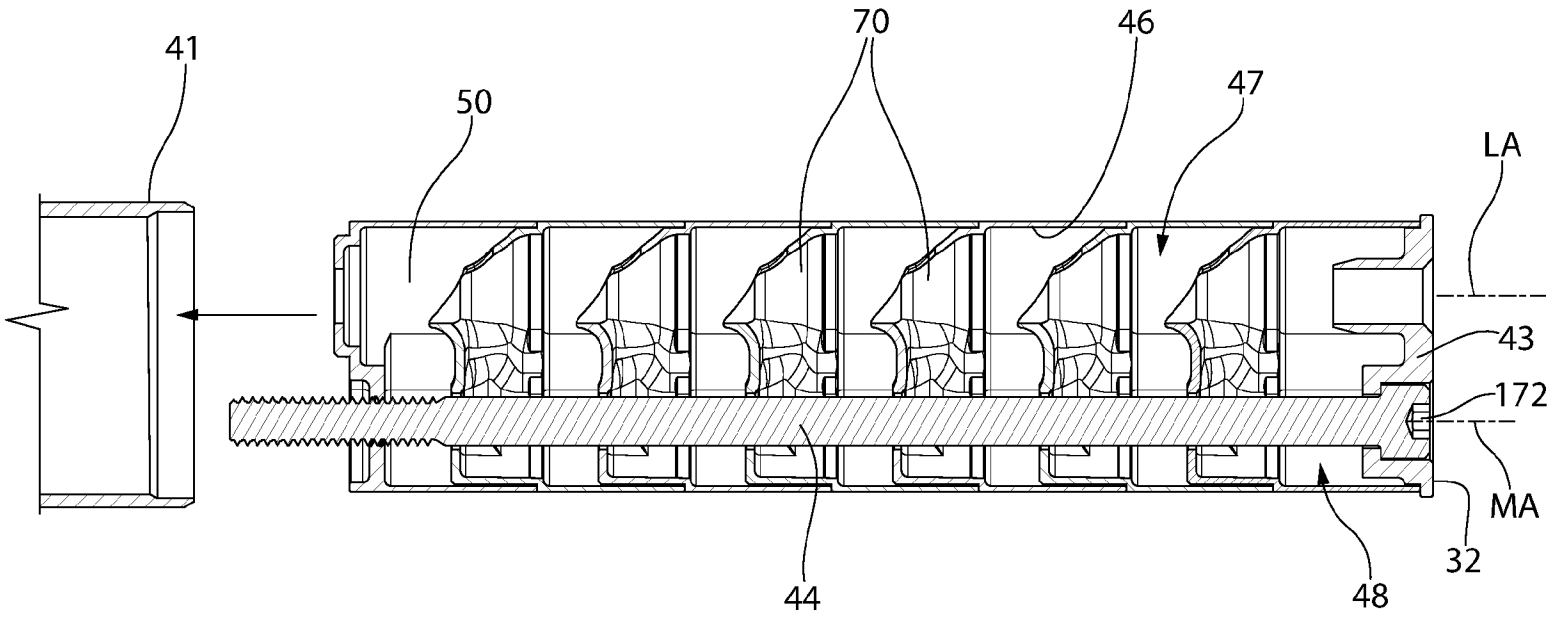
FIG. 15 is a right side view of a self-support baffle assembly of the integrally suppressed barrel of FIG. 1.

In one embodiment, the baffles 50, 70 may be preassembled onto the rod to produce a self-supporting and self-contained complete baffle assembly or unit in which the baffles are self-retained on the mounting rod 44 without sliding off and manually holding the baffles in place on the rod. Such a completed baffle stack unit is shown in FIG. 14. Advantageously, this allows the baffle unit to be simply inserted into or later removed from the outer sleeve 41 as a complete assembly without individually sliding each baffle one at a time into the sleeve in piece meal fashion. This saves assembly/disassembly time for the end user if the baffles are removed periodically for routine maintenance and avoids parts getting lost.

The baffle unit may be preassembled by first sliding front end cap 43 onto the rear end 121 of the mounting rod 44 via the lower aperture 133 and then sliding it forward to engage the head 136 of the rod. Aperture 133 is smaller in diameter than the head 136 which prevents the end cap from sliding off.

The primary baffles 70 may then be installed on the mounting rod 44 using one of two approaches. In a first approach, the baffles 70 may be slid onto the mounting rod one at a time in a similar manner as the front end cap via the lower mounting aperture 168. As each baffle is mounted on the rod, it is pressed and locked into the adjoining baffle via a friction fit in the manner as already described above. This interlocked relationship creates a gas tight seal between the baffles. Alternatively in a second approach, the primary baffles may be press fit together to form an interlocked stacked baffle assembly which is self supporting in its own right. The preassembled baffle stack may then be slid onto and along the mounting rod as a unit. Both approaches may be used and the invention is not limited to either one. In either case, the foremost baffle 70 is press fit onto the front end cap 43 via a friction fit in the manner already described herein.

Finally, the spacer baffle 50 is threadably engaged with the mating threaded rear end 121 of the baffle mounting rod 44 via threaded rear bottom aperture 56. This threaded engagement retains the entire stack of baffles 50, 70 on the rod, thereby forming and completing the self-supported baffle assembly.

Next, the preassembled unit of baffles 50, 70 is slideably inserted into the internal passageway 25 of the outer sleeve 41 through open front or distal end 102 of the sleeve. The baffle unit is oriented so that the mounting rod 44 is slid into the tubular lower longitudinal chamber 48 of the sleeve 41. Baffles 50, 70 are inserted such that the cones 72 face rearwards in the sleeve 41 (see, e.g. FIGS. 4A-B). The threaded rear end 121 of the mounting rod 44 is engaged with the threaded socket 118 of the barrel adapter 42 by rotating the rod using tooling socket 172 and a complementary shaped tool. This completes the integrally suppressed barrel assembly which appears as shown in FIGS. 4A and 4B. The mounting rod 44 defines a mounting axis MA which is parallel and below the longitudinal axis LA of the barrel assembly 30 coinciding with the barrel bore centerline.

To remove the baffle assembly from the outer sleeve 41, the mounting rod 44 is preferably rotated sufficiently to disengage the threaded rear end 121 from the threaded socket 118 of the barrel adapter 42, but not threadably disengage threaded bottom aperture 56 of the spacer baffle 50. This allows the entire stack of baffles 50, 70 to be removed from the sleeve 41 intact with the front end cap 43 as a unit (see, e.g. FIG. 14).

It bears noting that in lieu of the foregoing preferred baffle mounting approaches in which the baffles are preassembled on the mounting rod 44 and then inserted into the sleeve 41 as a unit, other variations of the method are possible. For example, in other less preferred but still usable approaches the baffles may alternatively be inserted one at a time through the open front distal end 102 of the sleeve 41 to form the baffle stack therein. The mounting rod 44 with front end cap 43 positioned thereon may be slid through the lower mounting apertures 168 of the primary baffles 70 and threadably engaged with the threaded bottom aperture 56 of spacer baffle 50, and then threaded socket 118 of the barrel adapter 42. Tightening the mounting rod 44 will compress and draw the baffles 50, 70 together to create the interlocked press fit relationship desired for creating a gas tight barrier.

Any suitable materials may be used for the integrally suppressed barrel assembly and its components described herein. Preferably, the components are formed of an appropriate metal including alloys (with exception of any seals as needed) such as aluminum, carbon steel, stainless steel, titanium, or other. In one representative but non-limiting example, the rear and front end cap 27, 28 may be formed of aluminum or stainless steel. The barrel adapter 42 for example may be formed of carbon or stainless steel. The blast and primary baffles 50, 70 may be formed of stainless steel or aluminum as examples. The outer sleeve 21 may be formed of aluminum as an example. The sleeve 21 could also be made of preferably titanium due to its light weight and strength, or alternatively but less preferably of a steel material such as stainless due to its added weight.

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made within the scope of the present disclosure. One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents.

What is claimed is:

1. An integrally suppressed barrel for a firearm, the barrel comprising:

a front muzzle end and a rear breech end;

a rear barrel portion extending adjacent the breech end, the rear barrel portion having a barrel bore defining a projectile pathway and a longitudinal axis;

a front barrel portion extending forward from the rear barrel portion to the muzzle end, the front barrel portion permanently affixed to the rear barrel portion and forming a structurally integral part of the barrel with the rear barrel portion;

the front barrel portion including a longitudinal internal passageway comprising a tubular upper longitudinal chamber coaxially aligned with the barrel bore and a tubular lower longitudinal chamber, the upper and lower longitudinal chambers in fluid communication through an intermediate waist section having a transverse width less than a transverse width of the upper and lower longitudinal chambers;

a plurality of sound suppression baffles longitudinally stacked in the internal passageway of the front barrel portion, the baffles each comprising an upper gas expansion chamber positioned in the upper longitudinal chamber and a lower gas expansion chamber below the upper gas expansion chamber, the upper and lower gas expansion chambers in fluid communication through a laterally constricted throat section interposed therebetween;

wherein when the firearm is discharged, combustion gas flows through the baffles from the upper gas expansion chamber, through the throat section, and into the lower gas expansion chamber of each baffle.

2. The integrally suppressed barrel according to claim 1, wherein the front barrel portion has a height which is greater than its width.

3. The integrally suppressed barrel according to claim 2, wherein the intermediate waist section of the front barrel portion is laterally constricted having a lateral width which is less than a lateral width of the upper and lower longitudinal chambers.

4. The integrally suppressed barrel according to claim 3, wherein the upper and lower longitudinal chambers of the front barrel portion are arcuately convexly curved and the intermediate waist section therebetween is arcuately concavely curved.

5. The integrally suppressed barrel according to claim 1, wherein each baffle includes a convexly curved tubular upper section that defines the upper gas expansion chamber and a convexly curved tubular lower section that defines the lower gas expansion chamber.

6. The integrally suppressed barrel according to claim 5, wherein each baffle includes a flow cone projecting axially rearward from the tubular upper section towards the breech end, the cone defining an oblong central opening concentrically aligned with and obliquely oriented to the longitudinal axis for receiving a projectile therethrough.

7. The integrally suppressed barrel according to claim 6, wherein the cone has a leading edge that is axially spaced farther rearward from the tubular upper section than an opposing trailing edge.

8. The integrally suppressed barrel according to claim 6, wherein the central opening faces upwards and rearwards.

9. The integrally suppressed barrel according to claim 6, further comprising an upper minor portion of the central aperture having a lateral width which is less than an adjoining lower major portion of the central aperture.

10. The integrally suppressed barrel according to claim 6, wherein the cone has an asymmetrical transverse cross section about the longitudinal axis.

11. The integrally suppressed barrel according to claim 10, wherein the cone has a concave upper half section and a concave lower half section, the upper half section having a different side profile than the lower half section.

12. The integrally suppressed barrel according to claim 5, further comprising a front end cap retained on the muzzle end of the barrel by an elongated mounting rod, the mounting rod extending rearwards from the front end cap through the lower tubular sections of the baffles and having a rear end threadably engaged with a receiver of a firearm.

13. The integrally suppressed barrel according to claim 1, wherein the front barrel portion is permanently affixed to the rear barrel portion by cross-pinning.

14. An integrally suppressed barrel for a firearm, the barrel comprising:

a rear barrel portion defining a rear breech end, the rear barrel portion having an axial barrel bore defining a projectile pathway and a longitudinal axis;

an axially elongated outer sleeve extending forward from the rear barrel portion and defining a front muzzle end through which a projectile exits the barrel, the sleeve permanently affixed to the rear barrel portion to form a structurally integral part of the barrel with the rear barrel portion;

the sleeve defining a longitudinal internal passageway comprising a convexly curved tubular upper section coaxially aligned with the longitudinal axis and coupled to a convexly curved tubular lower section by an intermediate waist section, the lower section offset from the longitudinal axis;

a plurality of sound suppression baffles longitudinally stacked in the internal passageway of the sleeve, the baffles each comprising an upper gas expansion chamber coaxially aligned with the longitudinal axis and a lower gas expansion chamber in fluid communication with the upper gas expansion chamber;

a front end cap removably retained to the muzzle end;

an elongated mounting rod engaging the front end cap and extending through the lower gas expansion chambers of the baffles, the mounting rod having a rear end threadably coupled to the rear barrel portion;

wherein when the firearm is discharged, combustion gas flows from the barrel bore and through the baffles from the upper gas expansion chamber to the lower gas expansion chamber of each baffle.

15. The integrally suppressed barrel according to claim 14, wherein the sleeve is permanently affixed to a rear barrel adapter which is in turn permanently affixed to the rear barrel portion, the rear barrel portion, barrel adapter, and sleeve forming a structurally integral unit.

16. The integrally suppressed barrel according to claim 14, wherein the intermediate waist section is dimensionally constricted having a smaller lateral width than the tubular upper and lower sections of sleeve.

17. The integrally suppressed barrel according to claim 16, wherein the sleeve has a vertically oblong shape with a greater height than a width.

18. The integrally suppressed barrel according to claim 14, further comprising a rear spacer baffle interposed between the stack of sound suppression baffles and the rear barrel portion, the mounting rod further threadably engaging the spacer baffle.

19. The integrally suppressed barrel according to claim 18, wherein threadably disengaging the mounting rod from the rear barrel portion and maintaining threaded engagement between the mounting rod and spacer baffle allows a baffle assembly collectively comprising the mounting rod, spacer baffle, sound suppression baffles, and front end cap to be removed from the sleeve as a self-supporting unit.

20. The integrally suppressed barrel according to claim 14, wherein the sound suppression baffles are configured and operable to form a frictional press fit between the baffles, the baffles when press fit together forming a self-supporting stack of baffles.

21. The integrally suppressed barrel according to claim 14, wherein the upper gas expansion chamber of each sound suppression baffle includes a rearwardly projecting flow cone coaxially aligned with longitudinal axis of the barrel bore, the cone defining an oblong central opening concentrically aligned with and obliquely oriented to the longitudinal axis for receiving a projectile and combustion gases therethrough.

22. A method for assembling an integrally suppressed barrel for a firearm, the method comprising:

providing a rear barrel portion defining an axial bore and longitudinal axis, a hollow outer sleeve permanently affixed to the rear barrel portion to form a structurally integral part of the barrel with the rear barrel portion and having an open distal end, a front end cap, a mounting rod, a spacer baffle, and a plurality of sound suppression primary baffles;

releasably attaching a front end of the rod to the front end cap;

sliding the plurality of primary baffles onto a threaded rear end of the rod, the primary baffles abuttingly contacting each other;

threadably engaging the spacer baffle with the rear end of the rod by rotating the rod, wherein a self-supporting baffle unit is formed;

sliding the baffle unit into the outer sleeve through the open distal end; and threadably engaging the rear end of the rod with a threaded socket disposed on the rear barrel portion by rotating the rod;

wherein the front end cap is secured inside the distal end of the outer sleeve.

23. The method according to claim 22, wherein the primary baffles and spacer baffle are frictionally press fit together to form a self-supporting baffle stack before the step of sliding the plurality of primary baffles onto the threaded rear end of the rod.

24. The method according to claim 22, wherein the front end cap is frictionally press fit to the front-most primary baffle.

25. The method according to claim 22, wherein the sleeve comprises a convexly curved tubular upper section coaxially aligned with the longitudinal axis and coupled to a convexly curved tubular lower section by a constricted intermediate waist section, the lower section offset from the longitudinal axis and having a lateral width, the waist section having a smaller lateral width than the upper and lower sections.

* * * * *